US007821481B2

(12) United States Patent
Take et al.

(10) Patent No.: US 7,821,481 B2
(45) Date of Patent: Oct. 26, 2010

(54) IMAGE DISPLAY APPARATUS, CONTROL SIGNAL GENERATING APPARATUS, IMAGE DISPLAY CONTROL METHOD, AND COMPUTER PROGRAM PRODUCT

(75) Inventors: Masahiro Take, Kanagawa (JP); Shoji Kosuge, Kanagawa (JP)

(73) Assignee: Sony Corporation, Tokyo (JP)

( * ) Notice: Subject to any disclaimer, the term of this patent is extended or adjusted under 35 U.S.C. 154(b) by 844 days.

(21) Appl. No.: 11/800,246

(22) Filed: May 4, 2007

(65) Prior Publication Data

US 2007/0262937 A1 Nov. 15, 2007

(30) Foreign Application Priority Data

May 9, 2006 (JP) ..... P2006-130683

(51) Int. Cl.
*G09G 3/36* (2006.01)

(52) U.S. Cl. ..... 345/96; 345/87

(58) Field of Classification Search ..... 345/87–102, 345/204

See application file for complete search history.

(56) References Cited

U.S. PATENT DOCUMENTS 5,825,346 A * 10/1998 Fujita ..... 345/619
6,819,311 B2 * 11/2004 Nose et al. ..... 345/100
7,079,102 B2 * 7/2006 Miyachi ..... 345/94
7,450,102 B2 * 11/2008 Lin et al. ..... 345/98
2001/0000662 A1 * 5/2001 Hashimoto et al. ..... 345/96
2001/0034075 A1 * 10/2001 Onoya ..... 438/34
2002/0067330 A1 * 6/2002 Okuzono ..... 345/96
2003/0132903 A1 * 7/2003 Ueda ..... 345/87
2004/0032386 A1 * 2/2004 Pai ..... 345/96
2004/0178979 A1 * 9/2004 Watanabe et al. ..... 345/96
2005/0168425 A1 * 8/2005 Takada et al. ..... 345/94
2006/0284819 A1 * 12/2006 Lin et al. ..... 345/100
2007/0013639 A1 * 1/2007 Lin et al. ..... 345/100
2007/0115237 A1 * 5/2007 Hirakata ..... 345/96
2007/0139337 A1 * 6/2007 Yeh et al. ..... 345/96

FOREIGN PATENT DOCUMENTS

JP 2001-042282 2/2001
JP 2003-36060 2/2003
JP 2004 302023 10/2004

* cited by examiner

*Primary Examiner*—Nitin Patel
(74) *Attorney, Agent, or Firm*—Frommer Lawrence & Haug LLP; William S. Frommer

(57) ABSTRACT

An image display apparatus includes a display unit including a liquid crystal panel; a video signal processor configured to perform signal processing on the basis of an image display form in the display unit; and an AC drive controller configured to control video display by receiving a result of the signal processing performed in the video signal processor and controlling a voltage applied to the liquid crystal panel included in the display unit. The AC drive controller performs, for each pixel of the liquid crystal panel, AC drive control of alternately switching a polarity between + and − in units of pairs of the same signal processing, each pair being two pixels on time series on which signal processing of the same category is performed in the video signal processor.

13 Claims, 14 Drawing Sheets

IMAGE DISPLAY APPARATUS, CONTROL SIGNAL GENERATING APPARATUS, IMAGE DISPLAY CONTROL METHOD, AND COMPUTER PROGRAM PRODUCT

CROSS REFERENCES TO RELATED APPLICATIONS

The present invention contains subject matter related to Japanese Patent Application JP 2006-130683 filed in the Japanese Patent Office on May 9, 2006, the entire contents of which are incorporated herein by reference.

BACKGROUND OF THE INVENTION

1. Field of the Invention

The present invention relates to an image display apparatus, a control signal generating apparatus, an image display control method, and a computer program product. More specifically, the present invention relates to an image display apparatus, a control signal generating apparatus, an image display control method, and a computer program product, for controlling display in a liquid crystal display apparatus to perform AC (alternating current) drive.

2. Description of the Related Art

In a liquid crystal display (LCD), liquid crystal is sealed between two substrates provided with electrodes and a predetermined voltage is applied across the electrodes, so that orientation of the liquid crystal is changed and a light transmittance is controlled for performing display. However, if a unidirectional DC (direct current) voltage is applied for a long period, so-called burn-in occurs, where the orientation of liquid crystal molecules is fixed.

In order to overcome this problem, in display apparatuses using liquid crystal, such as a television set, a monitor, and a projector (hereinafter collectively referred to as an LCD), so-called AC drive of periodically switching a polarity of charge applied to the liquid crystal between [+] and [−] is performed to improve an afterimage characteristic and to prevent burn-in of the liquid crystal. A method of the AC drive is described below with reference to FIG. 1. FIG. 1 shows, in time series, pixels arranged in the vertical direction of a frame image that is displayed in a display unit 11. An input image is a 60 Hz image, and interframe spacing between respective times t1, t2, t3, and t4 is 1/60 sec.

In the method shown in FIG. 1, the polarity is switched between [+] and [−] for every vertical line (vertical direction in the figure) and every frame (time axis direction) in frame images of the respective times t1, t2, t3, and t4.

In another AC drive method, the polarity is switched between [+] and [−] for every pixel in a horizontal line of a frame, for every line, and for every frame. In any method, [+] and [−] alternately appear if a specific pixel is observed in a time direction. This is based on an assumption that "no DC component is accumulated if positive and negative charge polarities are alternately applied in time direction in a pixel when a typical normal image is displayed". The burn-in can be prevented by the AC drive method. A known art of the AC drive method is disclosed in, for example, Patent Document 1 (Japanese Unexamined Patent Application Publication No. 2003-36060).

The LCD performs display on the basis of a plane hold method, unlike in a CRT (cathode ray tube) using point sequential impulse drive. That is, when the LCD operates at a typical frame frequency of 60 Hz, the same image is held on the entire screen for a display period of one frame (1/60 sec=16.7 msec).

In the plane hold display, images are displayed by performing IP conversion, where an interlace signal is converted to a progressive signal. This is because many of content and broadcast signals applied to display of images are generated as image data according to an interlace method for a CRT.

The image data according to the interlace method is displayed in the following manner. Each image includes two fields. In a first field, a screen is scanned on every other horizontal scanning line from the top to lower end. Then, in a second field that has not been scanned, the screen is scanned on every other horizontal scanning line from the top. Accordingly, an image is displayed. When image content is displayed by the interlace method in a display apparatus performing plane hold display, such as an LCD, a line having a display image signal and a line not having a display image signal alternately appear in each display frame, so that flicker significantly occurs and the luminance decreases by half disadvantageously. In order to solve this problem, IP conversion of converting an interlace signal to a progressive signal is performed.

In the IP conversion, a signal of a line not having a signal included in an interlace signal is generated by interpolation. By applying the pseudo signal generated by the interpolation, the interlace signal is converted to a progressive signal, so that display is performed by using the progressive signal in which every pixel includes a signal. However, the progressive signal includes pixel data generated by the interpolation, which causes a problem that an image different from original content is displayed. In order to realize display of an interlace signal equivalent to the original content, interpolation pixels may not be displayed, that is, black pixels may be displayed. More specifically, as shown in FIG. 2, interpolation pixels generated by IP conversion are not displayed by decreasing the luminance level thereof, and only original pixels included in the interlace signal are displayed.

However, if such a display process is performed and if the AC drive described above with reference to FIG. 1 is performed, the following sequence is realized as shown in FIG. 2. That is, in a pixel 12, for example, an original pixel is displayed under a [+] voltage applied at time t1, a pixel having a luminance level of 0 is displayed under a [−] voltage applied at time t2, the original pixel is displayed under a [+] voltage applied at time t3, and the pixel having a luminance level of 0 is displayed under a [−] voltage applied at time t4. In the pixel having a luminance level of 0 displayed at times t2 and t4, the applied voltage is substantially 0. As a result, a [+] voltage is accumulated in a portion corresponding to the pixel 12 of the LCD apparatus, which causes burn-in. This is the same in the other pixel portions.

SUMMARY OF THE INVENTION

The present invention has been made in view of the above-described problems, and is directed to providing an image display apparatus, a control signal generating apparatus, an image display control method, and a computer program product, capable of suppressing bias of an applied voltage and preventing accumulation of DC of charge even when an output level is adjusted in a display apparatus performing display control based on AC drive.

According to an embodiment of the present invention, there is provided an image display apparatus including a display unit including a liquid crystal panel; a video signal processor configured to perform signal processing on the basis of an image display form in the display unit; and an AC drive controller configured to control video display by receiving a result of the signal processing performed in the video signal processor and controlling a voltage applied to the liquid crystal panel included in the display unit. The AC drive controller performs, for each pixel of the liquid crystal panel, AC drive control of alternately switching a polarity between + and − in units of pairs of the same signal processing, each pair being two pixels on time series on which signal processing of the same category is performed in the video signal processor.

The image display apparatus further includes an AC drive pattern determining unit configured to determine an AC drive pattern on the basis of the image display form in the display unit. The AC drive controller performs AC drive control of alternately switching a polarity between + and − in units of pairs of the same signal processing in accordance with the AC drive pattern determined in the AC drive pattern determining unit.

The AC drive controller receives an instruction signal from the video signal processor and performs AC drive control of alternately switching a polarity between + and − in units of pairs of the same signal processing on the basis of the instruction signal.

The AC drive controller extracts the pairs of the same signal processing, the pairs including a pair of interpolation pixels which are interpolation line pixels generated in IP conversion, an output level of the interpolation pixels being decreased; and a pair of original pixels other than the interpolation pixels. Also, the AC drive controller switches the polarity for each of the interpolation pixels constituting the pair of interpolation pixels and switches the polarity for each of the original pixels constituting the pair of original pixels.

The AC drive controller extracts the pair of interpolation pixels and the pair of original pixels from image data on which n×process is performed, n being an integer of 2 or more, and switches the polarity for each of the interpolation pixels and each of the original pixels.

The video signal processor includes a frame controller configured to generate a plurality of sub-frames by performing time division on an input image frame; a high frequency emphasized sub-frame generator configured to generate high frequency emphasized sub-frames by filtering the sub-frames generated by the frame controller; a high frequency suppressed sub-frame generator configured to generate high frequency suppressed sub-frames by filtering the sub-frames generated by the frame controller; and an output controller configured to alternately output the high frequency emphasized sub-frames generated by the high frequency emphasized sub-frame generator and the high frequency suppressed sub-frames generated by the high frequency suppressed sub-frame generator to the AC drive controller. The AC drive controller extracts the pairs of the same signal processing, the pairs including a pair of pixels corresponding to the high frequency emphasized sub-frames; and a pair of pixels corresponding to the high frequency suppressed sub-frames. Also, the AC drive controller switches the polarity for each of the pixels constituting the pair of pixels corresponding to the high frequency emphasized sub-frames and switches the polarity for each of the pixels constituting the pair of pixels corresponding to the high frequency suppressed sub-frames.

The video signal processor includes a frame controller configured to generate a plurality of sub-frames by performing time division on an input image frame; a high frequency emphasized sub-frame generator configured to generate high frequency emphasized sub-frames by filtering the sub-frames generated by the frame controller; a high frequency suppressed sub-frame generator configured to generate high frequency suppressed sub-frames by filtering the sub-frames generated by the frame controller; a first output controller configured to alternately output the high frequency emphasized sub-frames generated by the high frequency emphasized sub-frame generator and the high frequency suppressed sub-frames generated by the high frequency suppressed sub-frame generator; a gain controller configured to adjust an output level of the sub-frame images output from the first output controller; and a second output controller configured to receive output from the first output controller and output from the gain controller, and to output level-adjusted interpolation pixels and level-nonadjusted original pixels to the AC drive controller, the level-adjusted interpolation pixels being generated by adjusting interpolation pixels generated by IP conversion with an output level adjusting signal output from the gain controller, and the level-nonadjusted original pixels being level-nonadjusted original pixel signals other than the interpolation pixels output from the first output controller. The AC drive controller extracts the pairs of the same signal processing, the pairs including (a) a pair of high frequency emphasized sub-frame original pixels including original pixels included in the high frequency emphasized sub-frames; (b) a pair of high frequency emphasized sub-frame interpolation pixels including level-adjusted interpolation pixels included in the high frequency emphasized sub-frames; (c) a pair of high frequency suppressed sub-frame original pixels including original pixels included in the high frequency suppressed sub-frames; and (d) a pair of high frequency suppressed sub-frame interpolation pixels including level-adjusted interpolation pixels included in the high frequency suppressed sub-frames. The AC drive controller switches the polarity for each of the pixels constituting the respective pixel pairs (a) to (d).

According to an embodiment of the present invention, there is provided a control signal generating apparatus to generate a control signal for controlling a display unit including a liquid crystal panel. The control signal generating apparatus includes an AC drive controller configured to control video display by receiving a result of signal processing performed in a video signal processor and controlling a voltage applied to the liquid crystal panel included in the display unit. The AC drive controller performs, for each pixel of the liquid crystal panel, AC drive control of alternately switching a polarity between + and − in units of pairs of the same signal processing, each pair being two pixels on time series on which signal processing of the same category is performed in the video signal processor.

The control signal generating apparatus further includes an AC drive pattern determining unit configured to determine an AC drive pattern on the basis of an image display form in the display unit. The AC drive controller performs AC drive control of alternately switching a polarity between + and − in units of pairs of the same signal processing in accordance with the AC drive pattern determined in the AC drive pattern determining unit.

The AC drive controller receives an instruction signal from the video signal processor and performs AC drive control of alternately switching a polarity between + and − in units of pairs of the same signal processing on the basis of the instruction signal.

According to an embodiment of the present invention, there is provided an AC drive control apparatus to control video display by controlling a voltage applied to a liquid crystal panel included in a display unit. In each pixel of the liquid crystal panel, the AC drive control apparatus performs AC drive control of alternately switching a polarity between + and − in units of pairs of the same signal processing, each pair being two pixels on time series on which signal processing of the same category is performed.

According to an embodiment of the present invention, there is provided an image display control method for performing image processing in an image display apparatus. The method includes the steps of: performing video signal processing on the basis of an image display form in a display unit including a liquid crystal panel, the step being performed in a video signal processor; and performing AC drive control to control video display by receiving a result of the signal processing performed in the video signal processor and controlling a voltage applied to the liquid crystal panel included in the display unit, the step being performed in an AC drive controller. The AC drive control step performs, for each pixel of the liquid crystal panel, AC drive control of alternately switching a polarity between + and − in units of pairs of the same signal processing, each pair being two pixels on time series on which signal processing of the same category is performed in the video signal processor.

According to an embodiment of the present invention, there is provided a computer program product allowing an image display apparatus to perform image processing. The computer program product includes the steps of: performing video signal processing on the basis of an image display form in a display unit including a liquid crystal panel, the step being performed in a video signal processor; and performing AC drive control to control video display by receiving a result of the signal processing performed in the video signal processor and controlling a voltage applied to the liquid crystal panel included in the display unit, the step being performed in an AC drive controller. The AC drive control step performs, for each pixel of the liquid crystal panel, AC drive control of alternately switching a polarity between + and − in units of pairs of the same signal processing, each pair being two pixels on time series on which signal processing of the same category is performed in the video signal processor.

The above-described computer program product can be provided to a multi-purpose computer system capable of performing various program codes via a storage medium or a communication medium, such a CD, FD, MO, or network in a computer readable manner. By providing the program in a computer readable manner, processes according to the program are performed in the compute system.

Other features of the present invention become apparent from the following description of exemplary embodiments with reference to the attached drawings. In this specification, a system is a logical set of a plurality of devices, and the respective devices are not always in the same cabinet.

According to a configuration of an embodiment of the present invention, a control process performed by an AC drive controller to control video display can be improved by controlling a voltage applied to a liquid crystal panel. Even when a process of adjusting an output level is performed, bias of an applied voltage can be suppressed and accumulation of DC of charge can be prevented. Specifically, a pair of pixels on which the same signal processing is performed in the time direction in a target pixel (or a target pixel line) is set, and AC drive of alternately switching between [+] and [−] is performed in units of pairs of signal processing of the same category. With this process, alternate switching between [+] and [−] is performed during display of the respective pairs of the same signal processing. Accordingly, balance of [+] and [−] is maintained, accumulation of [+] or [−] voltage can be prevented, and the possibility of occurrence of burn-in can be decreased.

DESCRIPTION OF THE PREFERRED EMBODIMENTS

Figure 3:
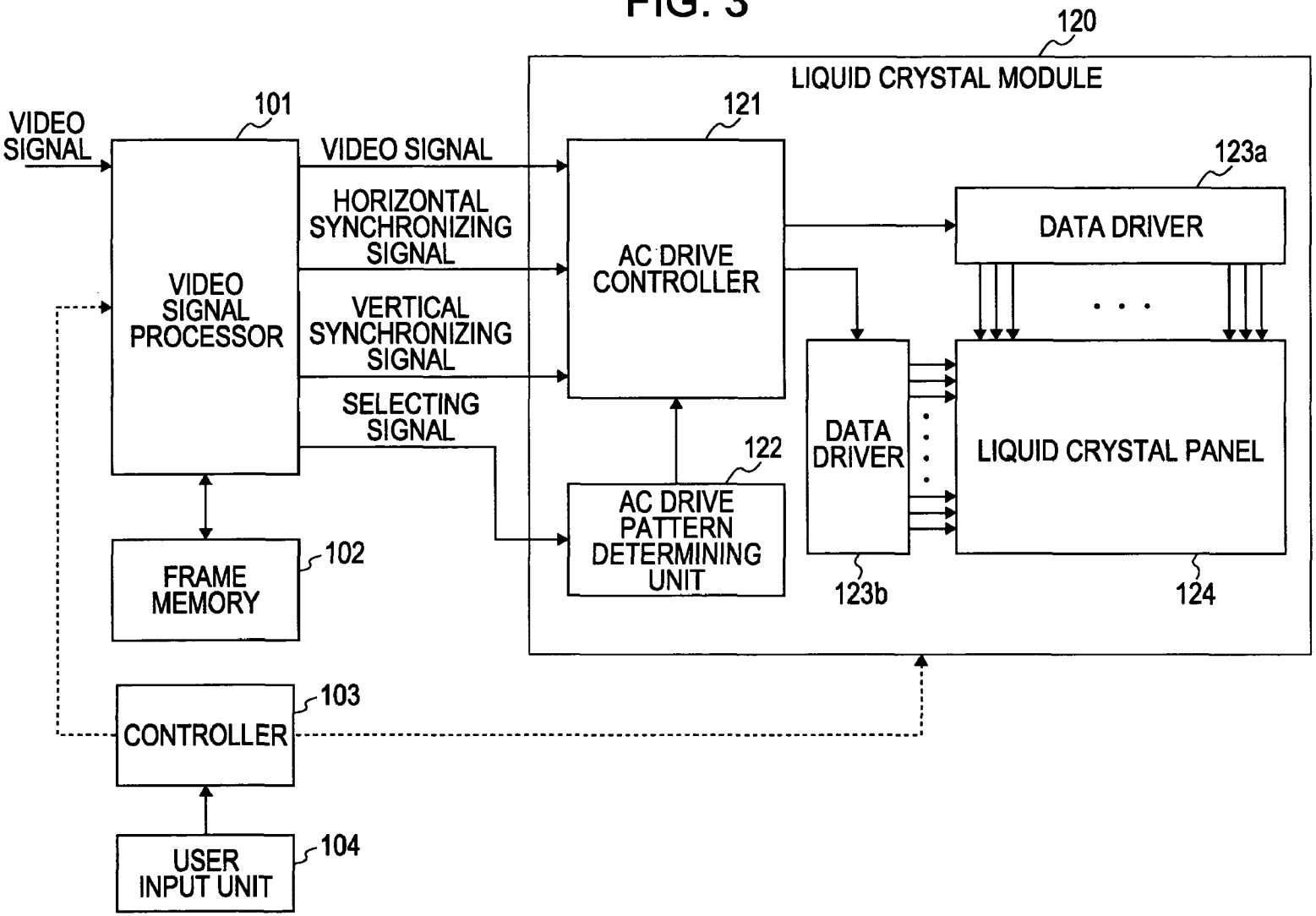
FIG. 3 is a block diagram showing an example of a configuration of a signal processing circuit in an image display apparatus according to an embodiment of the present invention.

Hereinafter, an image display apparatus, a control signal generating apparatus, an image display control method, and a computer program product according to an embodiment of the present invention are described in detail with reference to the drawings. First, an example of a configuration of the image display apparatus according to the embodiment of the present invention is described with reference to FIG. 3. As shown in FIG. 3, the image display apparatus includes a video signal processor 101, a frame memory 102, a controller 103, a user input unit 104, and a liquid crystal module 120. The liquid crystal module 120 includes an AC drive controller 121, an AC drive pattern determining unit 122, data drivers 123*a* and 123*b*, and a liquid crystal panel 124.

The liquid crystal panel 124 is a display unit including pixels arranged in a matrix pattern. The AC drive controller 121, the AC drive pattern determining unit 122, and the data drivers 123*a* and 123*b* serve as a control signal generating apparatus to control display in the liquid crystal panel 124. The AC drive controller 121 controls a voltage applied to liquid crystal corresponding to each pixel in the liquid crystal panel 124 as a display unit.

A video signal to be processed for display is input to the video signal processor 101, where the video signal is processed by IP conversion or n×process of frames, so that a video signal adaptable with a predetermined display form is generated. During signal processing performed in the video signal processor 101, the frame memory 102 is used as necessary for storing frame data. The video signal generated in the video signal processor 101 is supplied to the AC drive controller 121 of the liquid crystal module 120. Also, a horizontal synchronizing signal (H_Sync) and a vertical synchronizing signal (V_Sync) are supplied from the video signal processor 101 to the AC drive controller 121.

The AC drive controller 121 of the liquid crystal module 120 drives the data drivers 123*a* and 123*b* on the basis of the video signal, the horizontal synchronizing signal (H_Sync), and the vertical synchronizing signal (V_Sync) received from the video signal processor 101, so as to display image data on the liquid crystal panel 124.

The AC drive pattern determining unit 122 determines an AC drive sequence performed in the AC drive controller 121. For example, the AC drive pattern determining unit 122 determines a pattern of polarities [+] and [−] of the voltage to be applied to each pixel line of each frame, and provides information about the determined pattern to the AC drive controller 121. The AC drive controller 121 drives the data drivers 123*a* and 123*b* in accordance with the AC drive pattern received from the AC drive pattern determining unit 122, so as to display image data on the liquid crystal panel 124.

The AC drive controller 121 according to the embodiment of the present invention performs AC drive control on each pixel of the liquid crystal panel 124. In the AC drive control, a polarity is alternately switched between [+] and [−] in units of pairs of the same signal processing, each pair being two pixels on time series on which signal processing of the same category is performed in the video signal processor 101. A specific example of this process is described below in detail.

In the configuration shown in FIG. 3, the AC drive pattern determining unit 122 is provided as an independent element in the liquid crystal module 120. However, a process of determining an AC drive pattern may be performed in the video signal processor 101. This configuration is described below.

Even when a process of adjusting the output level of interpolation pixels generated by the above-described IP conversion is performed, the AC drive pattern determining unit 122 determines an AC drive pattern for suppressing bias of an applied voltage and preventing accumulation of DC of charge, and supplies information about the determined pattern to the AC drive controller 121.

The AC drive pattern determining unit 122 determines an AC drive pattern in accordance with the form of an image to be displayed on the liquid crystal panel 124. The form of an image to be displayed on the liquid crystal panel 124 can be set by a user in the user input unit 104. The information input through the user input unit 104 is input to the controller 103 and is supplied from the controller 103 to the AC drive pattern determining unit 122 of the liquid crystal module 120. Then, the AC drive pattern determining unit 122 determines an AC drive pattern in accordance with the display form on the basis of the input information. Hereinafter, process examples according to a plurality of display forms are described.

Process example 1: control to display an image in which IP conversion and adjustment of output level of interpolation pixels are performed Process example 2: control to display an image in which IP conversion, n×process, and adjustment of output level of interpolation pixels are performed Process example 3: control to display an image in which a high frequency suppressed sub-frame and a high-frequency emphasized sub-frame are alternately output Process example 4: control to display an image in which a high frequency suppressed sub-frame and a high-frequency emphasized sub-frame are alternately output and adjustment of output level of interpolation pixels is performed

PROCESS EXAMPLE 1

Figure 4:
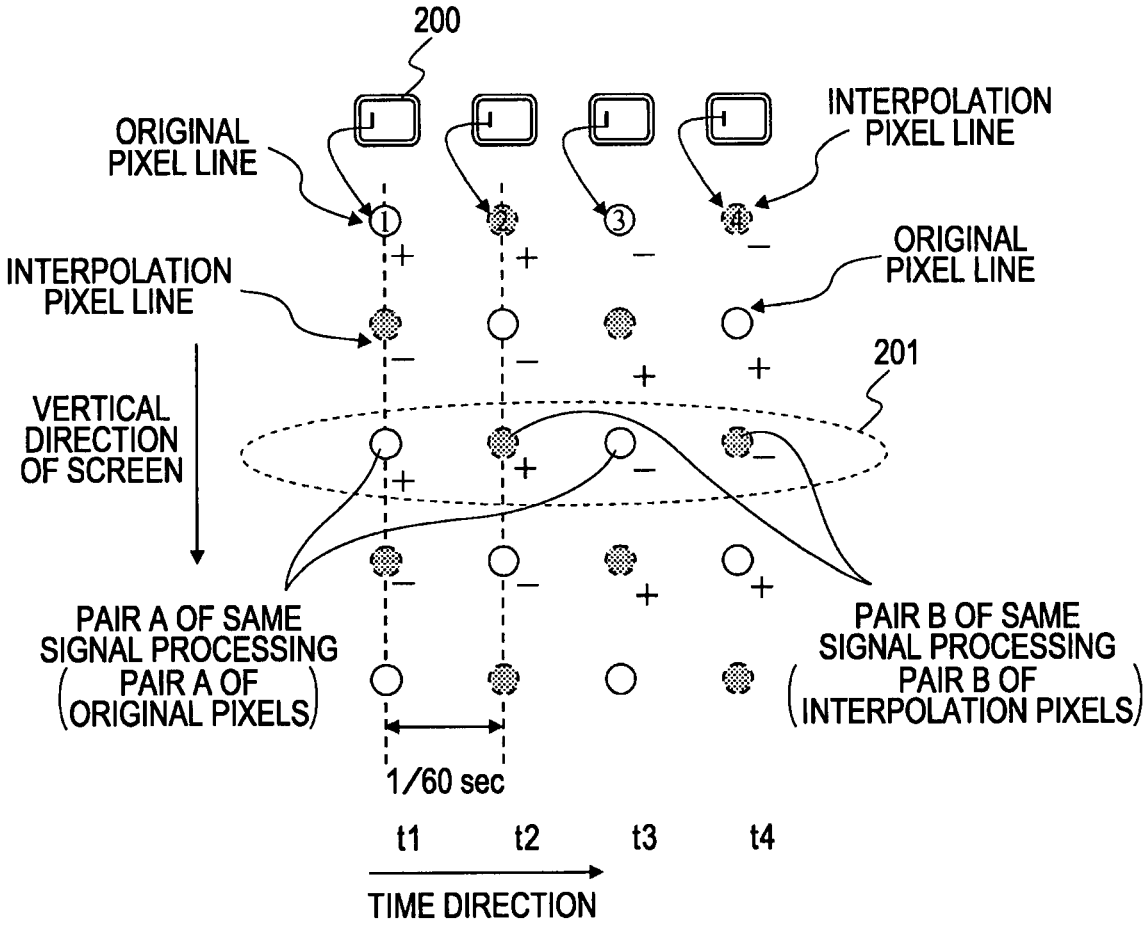
FIG. 4 illustrates an example of an AC drive process (process example 1) performed in the image display apparatus according to the embodiment of the present invention.

As process example 1, control to display an image in which IP conversion and adjustment of output level of interpolation pixels are performed is described with reference to FIG. 4 and so on. FIG. 4 shows, in time series, pixels in the vertical direction of a frame image that is displayed in a display unit 200. An input image is a 60 Hz image, and interframe spacing between respective times t1, t2, t3, and t4 is 1/60 sec.

Figure 1:
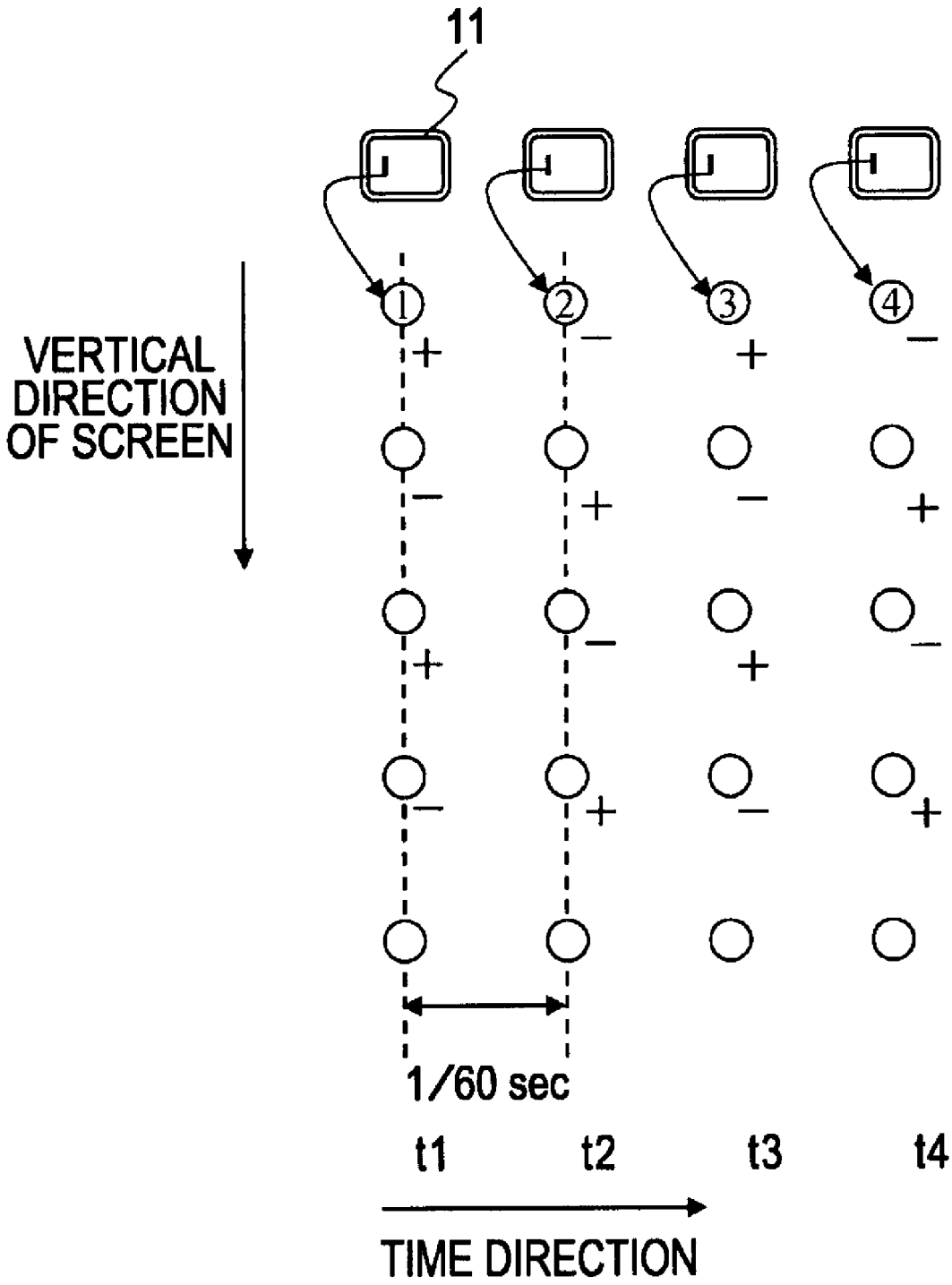
FIG. 1 illustrates an example of an AC drive process.
Figure 2:
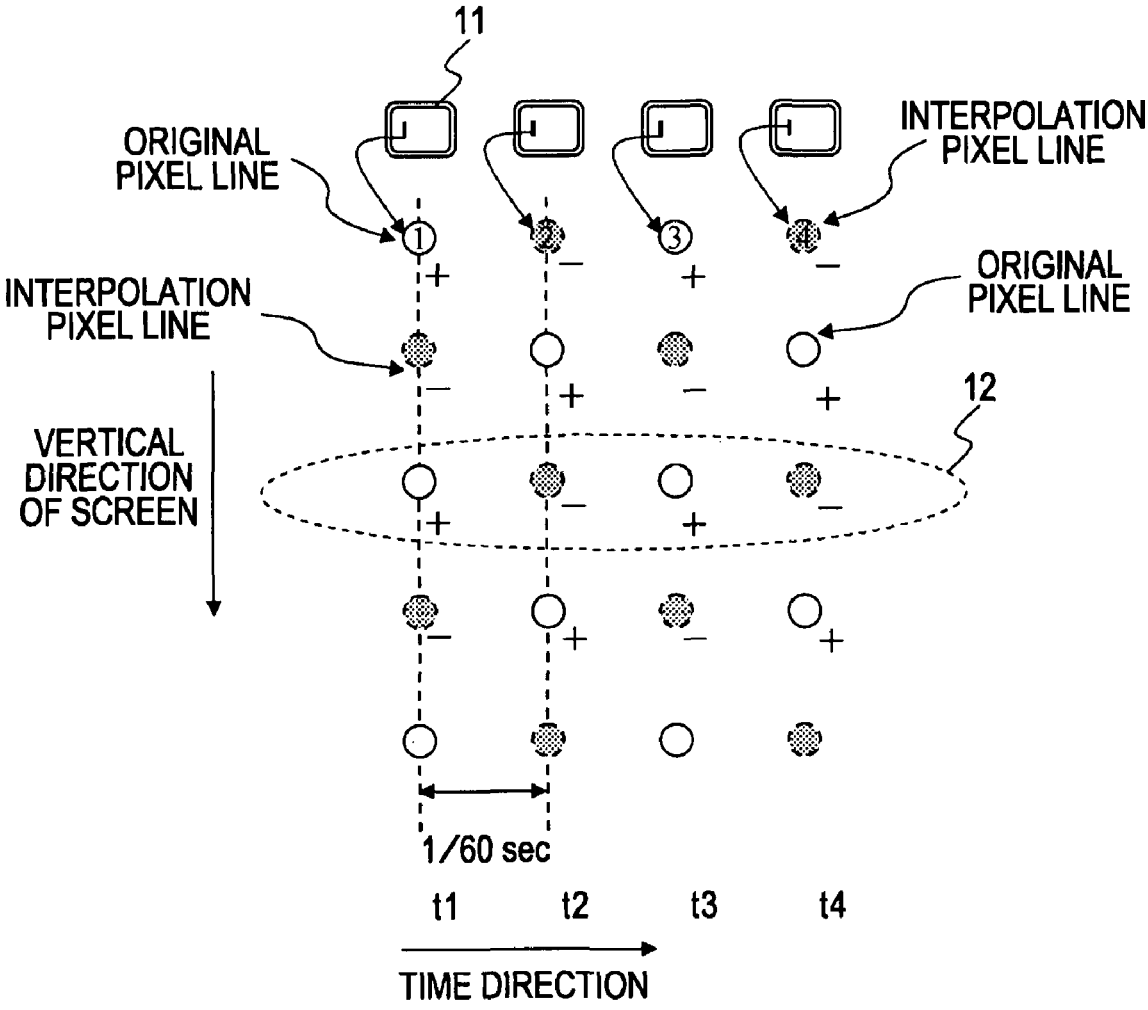
FIG. 2 illustrates a problem about AC drive in display of an image having interpolation pixels.

As described above with reference to FIG. 2, when an interlace signal is to be displayed in a plane hold display, IP conversion of converting an interlace signal to a progressive signal is performed in order to prevent occurrence of flicker. In the IP conversion, a signal of a line not having a signal included in an interlace signal is generated by interpolation. By applying the pseudo signal generated by the interpolation, the interlace signal is converted to a progressive signal, so that display is performed by using the progressive signal in which every pixel includes a signal.

However, the progressive signal includes pixel data generated by the interpolation, so that an image different from original content is displayed disadvantageously. In order to realize display of an interlace signal equivalent to the original content, interpolated pixels may not be displayed, that is, black pixels may be displayed. This process is described above with reference to FIG. 2.

In such a display process, if the conventional AC drive is performed, that is, if a corresponding same pixel is driven by alternately switching between [+] and [−] in each frame, interpolation pixels having a luminance level of 0 set every other frame are displayed substantially under an applied voltage of 0, as described above with reference to FIG. 2. As a result, pixels included in the original interlace signal are displayed by an applied voltage of any one of [+] and [−]. Accordingly, a voltage of [+] or [−] is accumulated, so that burn-in occurs.

In this process example, in order to prevent the burn-in, a pair of pixels on which the same signal processing is performed in a time direction is set in a target pixel (or a target pixel line), as shown in FIG. 4, and AC drive of alternately switching between [+] and [−] is performed in units of pairs of the same signal processing.

In the example shown in FIG. 4, a pixel 201 is focused on. In this case, an original pixel of an unchanged luminance level is displayed at times t1, t3, t5, t7, . . ., whereas an interpolation pixel of a decreased luminance level is displayed at times t2, t4, t6, t8, . . . .

In this method of displaying pixels, pairs on which the same signal processing is performed are defined as follows, as shown in FIG. 4:

(1) pair A of original pixels; and (2) pair B of interpolation pixels.

In this process example, AC drive of alternately switching between [+] and [−] is performed in units of pairs of the same signal processing. More specifically, the polarity of charge applied to liquid crystal in (1) pair A of original pixels is set to a pair of [+] and [−], and also the polarity of charge applied to liquid crystal in (2) pair B of interpolation pixels is set to a pair of [+] and [−]. That is, in each pixel of the liquid crystal panel 124, the AC drive controller 121 performs AC drive control of alternately switching the polarity between [+] and [−] in units of pairs of the same signal processing, each pair being two pixels on time series on which signal processing of the same category is performed in the video signal processor 101.

According to the above-described AC drive, when the pixel 201 is focused on, for example, an original pixel of an unchanged luminance level is displayed at times t1, t3, t5, t7, . . . . The polarity is alternately switched between [+] and [−] in frames corresponding to the respective times. Likewise, an interpolation pixel of a decreased luminance level is displayed at times t2, t4, t6, t8, . . . . The polarity is alternately switched between [+] and [−] in frames corresponding to the respective times.

As a result, alternate switching between [+] and [−] is performed at times t1, t3, t5, t7, . . . , when the original pixel is displayed. Accordingly, balance of [+] and [−] is maintained and accumulation of [+] or [−] voltage can be prevented. Also, alternate switching between [+] and [−] is performed at times t2, t4, t6, t8, . . . , when the interpolation pixel of a controlled level is displayed. Accordingly, balance of [+] and [−] is maintained and accumulation of [+] or [−] voltage can be prevented.

In this process example, AC drive is repeated in a pattern of [+][+][−][−] on a four-frame cycle. Hereinafter, an example of setting a polarity in AC drive corresponding to each line in this process example is described with reference to FIG. 5.

Figure 5:
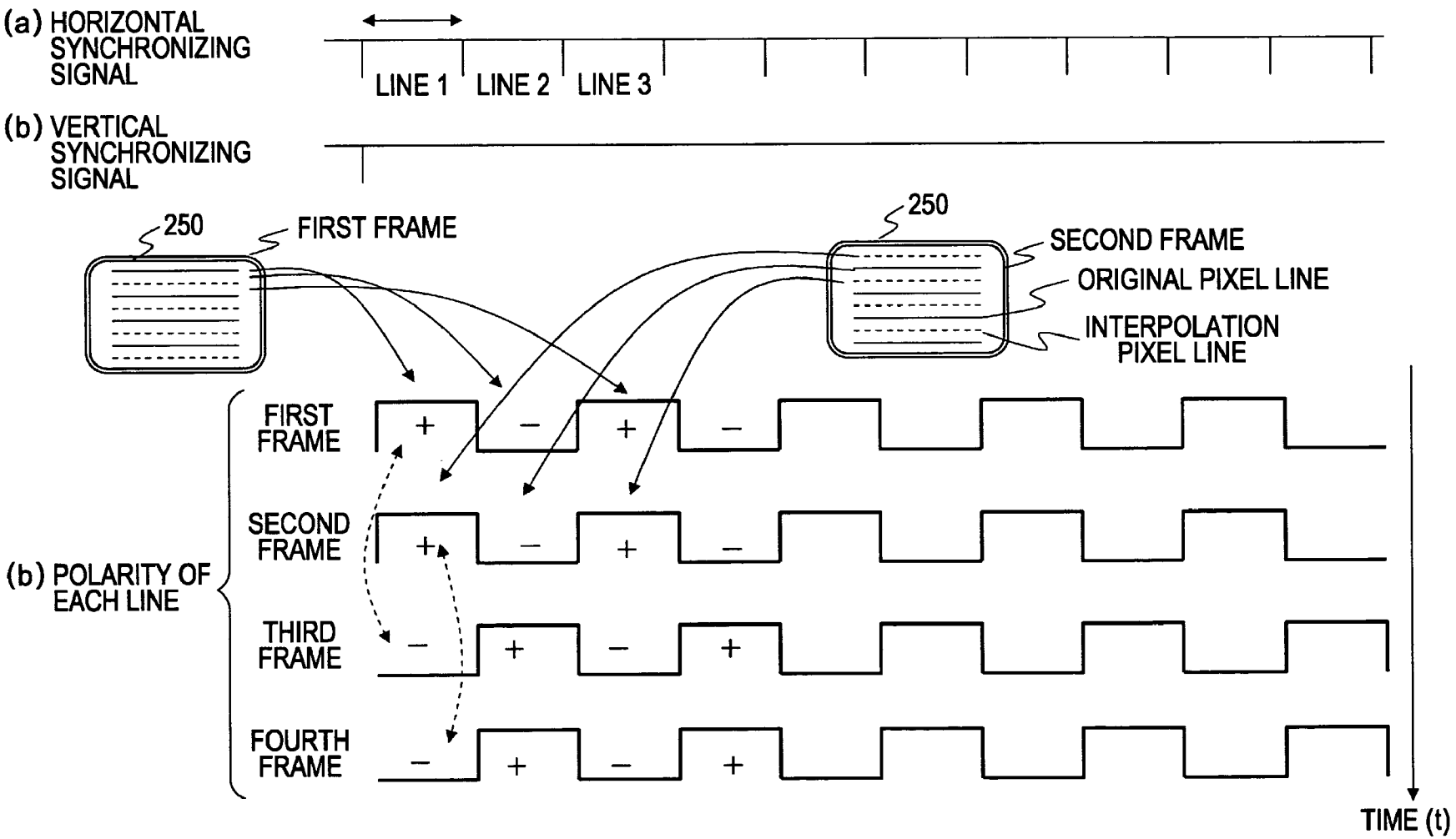
FIG. 5 illustrates the example of the AC drive process performed in the image display apparatus according to the embodiment of the present invention.

FIG. 5 shows (a) horizontal synchronizing signal; (b) vertical synchronizing signal; and (c) polarity of each line (first to fourth frames).

In a display unit 250, original pixel lines (solid lines) and interpolation pixel lines (broken lines) generated by interpolation in IP conversion are shown. The original pixel lines and the interpolation pixel lines are alternately displayed in each frame.

In (c) polarity of each line (first to fourth frames), in the first frame, for example, the polarity of AC drive is set to [+], [−], [+], [−], . . . in respective lines 1, 2, 3, Likewise, in the second frame, the polarity of AC drive is set to [+], [−], [+], [−], . . . in respective lines 1, 2, 3, . . . . On the other hand, in the third frame, the polarity of AC drive is reversed and is set to [−], [+], [−], [+], . . . in respective lines 1, 2, 3, . . . . Likewise, in the fourth frame, the polarity of AC drive is set to [−], [+], [−], [+], . . . in respective lines 1, 2, 3, The corresponding pixels (lines) in the first and third frames form a pair of the same signal processing described above with reference to FIG. 4. Also, the corresponding pixels (lines) in the second and fourth frames form a pair of the same signal processing. That is, the original pixel line and the interpolation pixel line are set every other frame on the same line. Thus, in all lines in (c) polarity of each line (first to fourth frames) shown in FIG. 5, the pattern of polarities is set to repetition of [+][+][−][−] in the time axis direction (from top to bottom).

As described above, in this process example, AC drive is performed on a four-frame cycle. Accordingly, the polarity is alternately switched between [+] and [−] at times t1, t3, t5, t7, . . . , when the original pixel is displayed, balance of [+] and [−] is maintained, and thus voltage of [+] or [−] is not accumulated. Likewise, the polarity is alternately switched between [+] and [−] at times t2, t4, t6, t8, . . . , when the interpolation pixel is displayed, balance of [+] and [−] is maintained, and thus voltage of [+] or [−] is not accumulated. As a result, accumulation of charge can be suppressed even if a display period continues, so that the possibility of occurrence of burn-in can be decreased.

PROCESS EXAMPLE 2

Hereinafter, control to display an image in which IP conversion, n×process (n is an integer of 2 or more), and adjustment of output level of interpolation pixels are performed is described. Herein, assume a case where the speed of the display process according to process example 1 is doubled. For example, when input image data is 60 Hz image data, the speed thereof is doubled and the image data is displayed as 120 Hz image data.

In a plane hold display such as an LCD, moving image blurring occurs due to a retinal afterimage. That is, when a moving object is displayed in a plane hold display unit, the eyes of a watcher follow the moving object and the image thereof slips on retina. Accordingly, so-called blurring occurs and the quality of the moving image degrades.

As a configuration to alleviate the blurring, it is known that a display apparatus having a fast responsivity is effectively applied. For example, display is switched at 120 Hz, that is, an actual image is displayed during a period of 1/120 sec, black is displayed during a next period of 1/120 sec, a next actual image is displayed during a next period of 1/120 sec, and black is displayed during a next period. In this way, by inserting black between frames displayed, display approximate to impulse drive display can be performed. It is known that, in the impulse drive display, blurring is alleviated because an actual display period is short.

In the plane hold display apparatus, display approximate to the impulse drive display can be performed by doubling a 60 Hz image to a 120 Hz image. For this purpose, so-called black insertion has been suggested. However, if the black insertion is performed and if the conventional AC drive described above with reference to FIG. 2 is performed, an applied [+] or [−] voltage accumulates, which leads to occurrence of burn-in.

Figure 6:
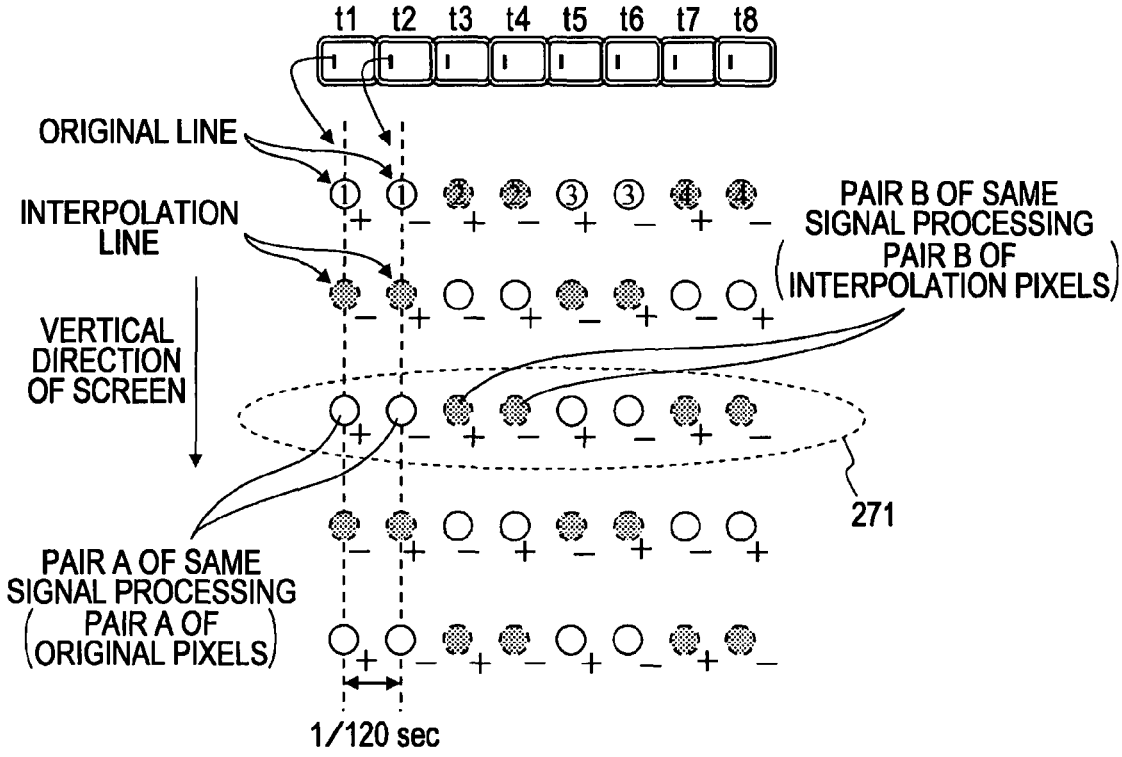
FIG. 6 illustrates another example of the AC drive process (process example 2) performed in the image display apparatus according to the embodiment of the present invention.

Hereinafter, an example of AC drive according to an embodiment of the present invention is described with reference to FIG. 6. FIG. 6 shows, in time series, pixels in the vertical direction of a frame image that is displayed in a display unit. For example, the displayed image is a 120 Hz image generated by doubling a 60 Hz image. The interframe spacing between respective times t1, t2, t3, t4, . . . is 1/120 sec. A speed-doubling process is performed by time division of 60 Hz image data into two sub-frames. In this case, as shown in FIG. 6, two continuous frames of original pixels or interpolation pixels are displayed in the same line. That is, display of [original pixel] [original pixel] and [interpolation pixel] [interpolation pixel] is repeatedly performed at intervals of 1/120 sec.

In the image display apparatus according to the embodiment of the present invention, as described above in process example 1, a pair of pixels on which the same signal processing is performed in the time direction in a target pixel (or a target pixel line) is set, and AC drive of alternately switching between [+] and [−] is performed in units of pairs of the same signal processing.

In the example of the process of displaying a 120 Hz image shown in FIG. 6, a target pixel 271 is focused on, for example. In this case, an original pixel having an unchanged luminance level is displayed at times t1, t2, t5, t6, . . . , whereas an interpolation pixel having a decreased luminance level is displayed at times t3, t4, t7, t8, . . . .

In this method of displaying pixels, pairs on which the same signal processing is performed are defined as follows, as shown in FIG. 6:

(1) pair A of original pixels; and (2) pair B of interpolation pixels.

In this process example, AC drive of alternately switching between [+] and [−] is performed in units of pairs of the same signal processing. More specifically, the polarity of charge applied to liquid crystal in (1) pair A of original pixels is set to a pair of [+] and [−], and also the polarity of charge applied to liquid crystal in (2) pair B of interpolation pixels is set to a pair of [+] and [−]. That is, in each pixel of the liquid crystal panel 124, the AC drive controller 121 performs AC drive control of alternately switching the polarity between [+] and [−] in units of pairs of the same signal processing, each pair being two pixels on time series on which signal processing of the same category is performed in the video signal processor 101.

According to the above-described AC drive, when the pixel 271 is focused on, for example, an original pixel of an unchanged luminance level is displayed at times t1, t2, t5, t6, . . . . The polarity is alternately switched between [+] and [−] in frames corresponding to the respective times. Likewise, an interpolation pixel of a decreased luminance level is displayed at times t3, t4, t7, t8, . . . . The polarity is alternately switched between [+] and [−] in frames corresponding to the respective times.

As a result, alternate switching between [+] and [−] is performed during display of the original pixel. Accordingly, balance of [+] and [−] is maintained and accumulation of [+] or [−] voltage can be prevented. Also, alternate switching between [+] and [−] is performed during display of the interpolation pixel of a controlled level. Accordingly, balance of [+] and [−] is maintained and accumulation of [+] or [−] voltage can be prevented. In this process example, AC drive is repeated in a pattern of [+][−] on a two-frame cycle.

In the above-described example, the process performed on an image doubled from 60 Hz to 120 Hz is described. Also, the same effect as in the above-described example can be obtained when the speed is quadrupled, if the polarity is switched in units of pairs of signal processing of the same category. That is, pairs of interpolation pixels and pairs of original pixels are extracted from image data on which n×process (n is an integer of 2 or more) is performed in the AC drive controller 121, and the polarity is switched for every interpolation pixel and every original pixel. Accordingly, burn-in can be prevented.

PROCESS EXAMPLE 3

Next, control to display an image in which a high frequency suppressed sub-frame and a high-frequency emphasized sub-frame are alternately output is displayed. In process example 2, black insertion is performed to display doubled frame images of 120 Hz in order to alleviate blurring of images.

The assignee of the present invention has suggested a configuration of performing a process different from the black insertion on image signals in order to suppress a decrease in luminance level and contrast and to alleviate blurring, and has disclosed the configuration in another patent application. More specifically, a high frequency suppressed sub-frame in which an image area of high frequency (high frequency area) is suppressed is displayed between high frequency emphasized sub-frames. The image area of high frequency includes an area where blurring is conspicuous, that is, a part (edge) having a significant change in contrast or an outline. Accordingly, blurring can be effectively alleviated. Also, by compensating an effect of insertion of high frequency suppressed sub-frames on image quality by using high frequency emphasizing sub-frames, images can be displayed while preventing degradation of brightness and contrast.

Figure 7:
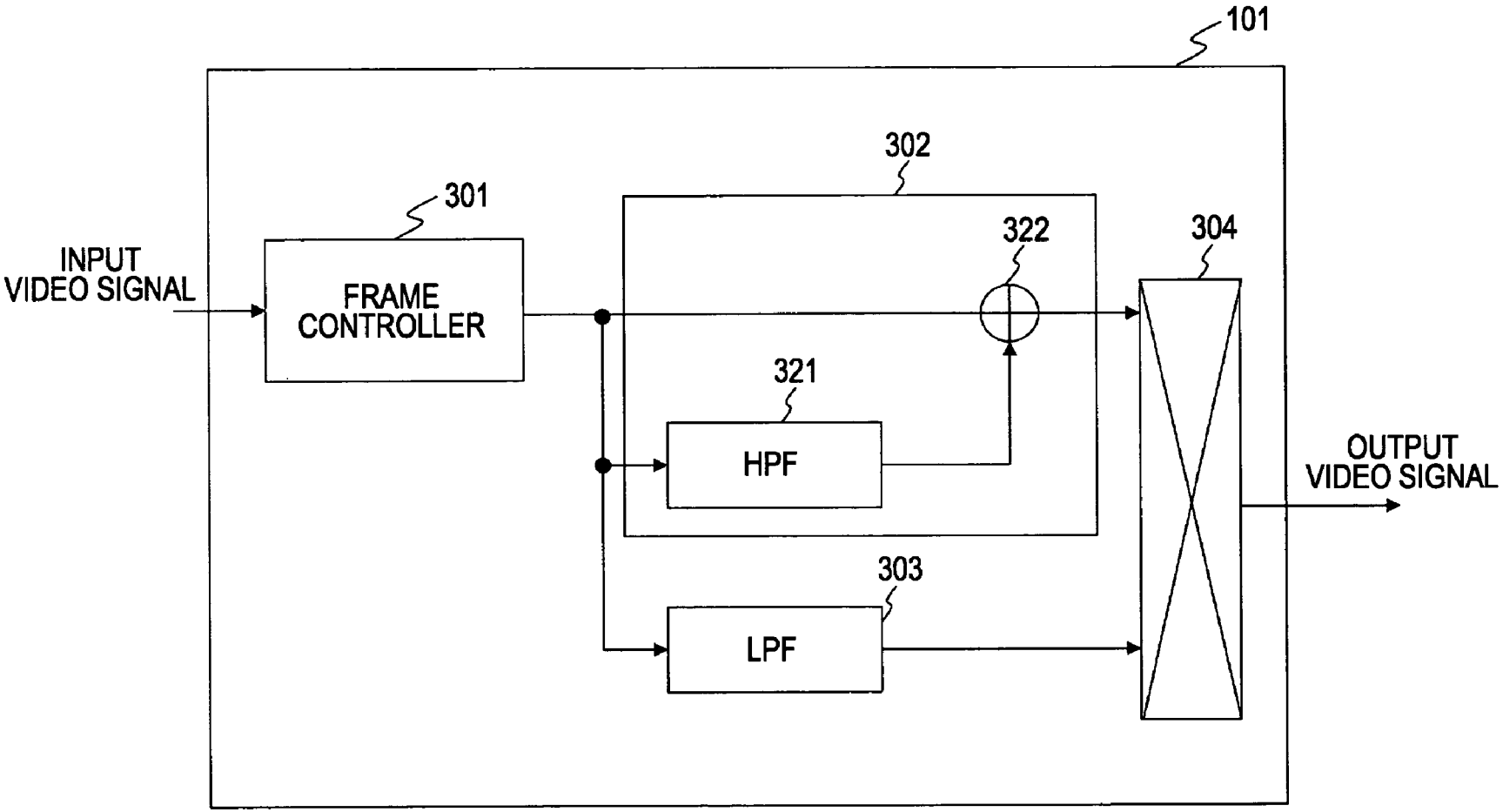
FIG. 7 shows an example of a configuration of a signal processing circuit of a video signal processor in the image display apparatus according to the embodiment of the present invention.

In this process example, the video signal processor 101 shown in FIG. 3 performs signal processing on the basis of an input video signal so as to generate high frequency emphasized and high frequency suppressed sub-frames, and outputs them as an output video signal. An example of video signal processing performed in the video signal processor 101 corresponding to this process example is described with reference to FIG. 7. As shown in FIG. 7, the video signal processor 101 includes a frame controller 301, a high frequency emphasized sub-frame generator 302, a low-pass filter (LPF) 303 serving as a high frequency suppressed sub-frame generator, and a selector 304. The high frequency emphasized sub-frame generator 302 includes a high-pass filter (HPF) 321 and an adder 322.

In the input video signal, a display period of each frame is set to 1/60 sec=16.7 msec. That is, the video signal corresponds to image data having a vertical frequency of 60 Hz. The frame controller 301 performs an n×process on the image signal of 60 Hz. In this case, n is a value larger than 1.

The frame controller 301 performs an n×process on input image data, divides each frame into n sub-frames, and outputs the sub-frames. For example, when n=2, each frame is divided into two sub-frames by time division so that the 60 Hz image data is converted to 120 Hz image data. Then, the 120 Hz image data is output to the HPF 321 of the high frequency emphasized sub-frame generator 302 and the LPF 303 serving as a high frequency suppressed sub-frame generator.

In the HPF 321 and the LPF 303, the time-divided sub-frames are alternately input from the frame controller 301, a low frequency cutting process or a high frequency cutting process is performed on each of the input sub-frames, and then the sub-frames are output.

The HPF 321 performs a filtering process of cutting a low space frequency part of an input sub-frame image and allowing a high frequency area, such as a part where contrast significantly changes (edge) or an outline, to pass therethrough. Data output from the HPF 321 is added to a sub-frame image based on an original image before filtering in the adder 322, and is output to the selector 304. The output from the adder 322 corresponds to a high frequency emphasized sub-frame image in which a high frequency area, such as a part where contrast significantly changes (edge) or an outline, is emphasized.

On the other hand, the LPF 303 performs a filtering process of cutting a high space frequency part of an input sub-frame image and allowing a low frequency area to pass therethrough. Data output from the LPF 303 is input to the selector 304. The output from the LPF 303 corresponds to a high frequency suppressed sub-frame image in which a high frequency area, such as a part where contrast significantly changes (edge) or an outline, is suppressed. This LPF process only suppresses a high frequency area and has no effect on a DC component as a low frequency component. Accordingly, significant degradation in brightness and contrast can be prevented.

The selector 304 functions as an output controller to alternately output a high frequency emphasized sub-frame, which is an output of the adder 322, and a high frequency suppressed sub-frame, which is an output of the LPF 303, at predetermined output timings.

For example, an input image is a 60 Hz image, sub-frames of 120 Hz are generated in the frame controller 301, the HPF 321 and the LPF 303 perform a filtering process on the sub-frames compatible with 120 Hz, respectively, and result data is input to the selector 304. In this case, the respective sub-frame images, that is, the high frequency emphasized sub-frame output from the adder 322 and the high frequency suppressed sub-frame output from the LPF 303 are alternately output at intervals of 1/120 sec.

The outputs are input to the AC drive controller 121 of the liquid crystal module 120 shown in FIG. 3. Then, under predetermined AC drive control, the high frequency emphasized sub-frame and the high frequency suppressed sub-frame are alternately displayed in the liquid crystal panel 124 at intervals of 1/120 sec. As described above, in this process example, blurring can be alleviated by displaying a high frequency suppressed sub-frame, in which a high frequency image area (high frequency area), such as a part where contrast significantly changes and blurring is conspicuous (edge) or an outline, is suppressed, between high frequency emphasized sub-frames. Also, by compensating an effect of insertion of the high frequency suppressed sub-frame on image quality, e.g., degradation in contrast, by using a high frequency emphasized sub frame, images can be displayed while preventing degradation in brightness and contrast.

Figure 8:
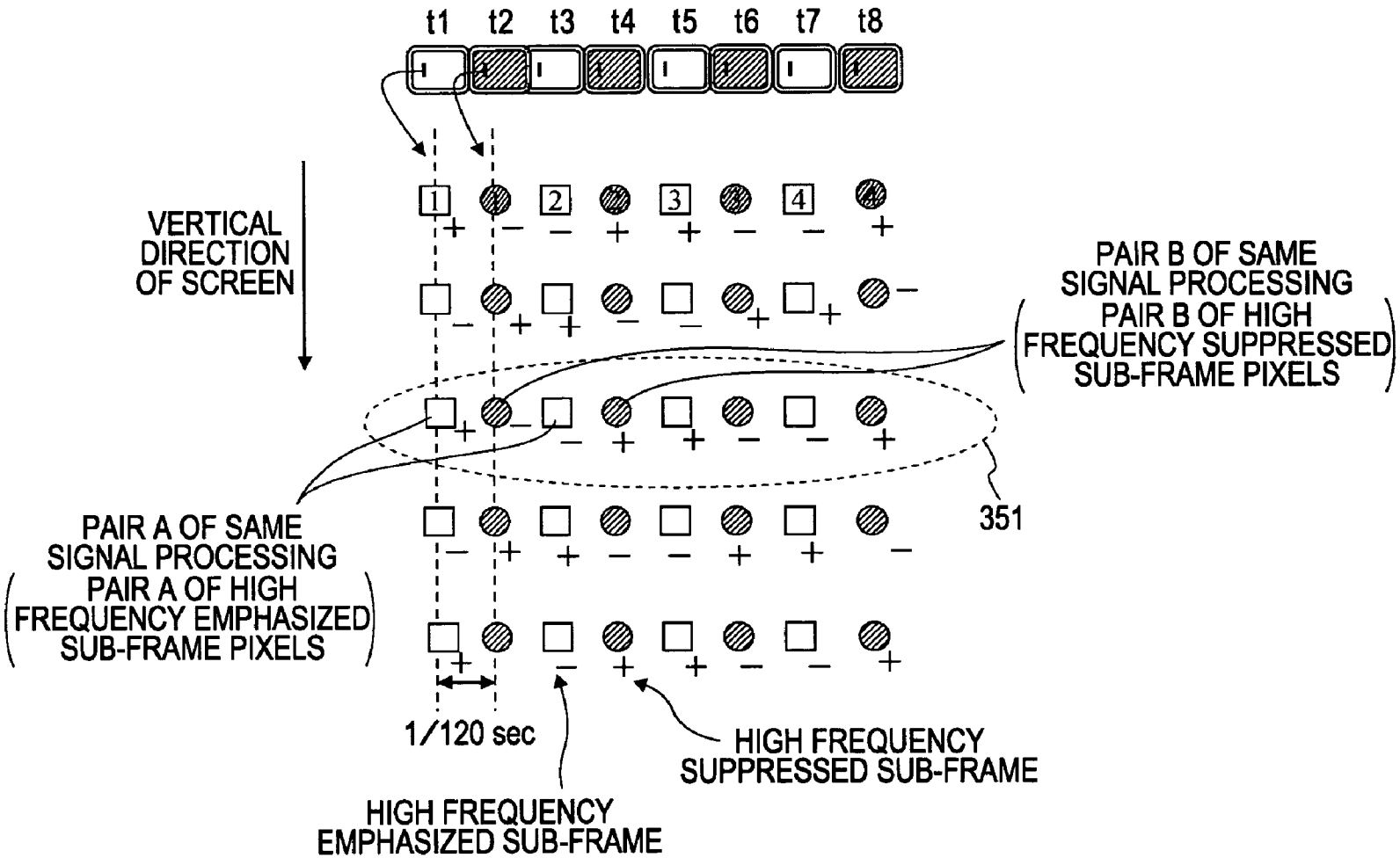
FIG. 8 illustrates another example of the AC drive process (process example 3) performed in the image display apparatus according to the embodiment of the present invention.

AC drive of alternately displaying the above-described high frequency emphasized sub-frame and high frequency suppressed sub-frame is described with reference to FIG. 8. FIG. 8 shows, in time series, pixels in the vertical direction of a frame image displayed in the display unit. For example, the image is a 120 Hz image generated by doubling a 60 Hz image. The interframe spacing between respective times t1, t2, t3, t4, . . . is 1/120 sec. In this process example, a high frequency emphasized sub-frame and a high frequency suppressed sub-frame are alternately displayed at intervals of 1/120 sec, as shown in FIG. 8.

In the image display apparatus according to the embodiment of the present invention, as described above in process example 1, a pair of pixels on which the same signal processing is performed in the time direction in a target pixel (or a target pixel line) is set, and AC drive of alternately switching between [+] and [−] is performed in units of pairs of the same signal processing.

In the example of the process of displaying a 120 Hz image shown in FIG. 8, a target pixel 351 is focused on, for example. In this case, a pixel corresponding to a high frequency emphasized sub-frame is displayed at times t1, t3, t5, t7, . . . , whereas a pixel corresponding to a high frequency suppressed sub-frame is displayed at times t2, t4, t6, t8, . . . .

In this method of displaying pixels, pairs on which the same signal processing is performed are defined as follows, as shown in FIG. 8:

(1) pair A of high frequency emphasized sub-frame pixels; and (2) pair B of high frequency suppressed sub-frame pixels.

In this process example, AC drive of alternately switching between [+] and [−] is performed in units of pairs of the same signal processing. More specifically, the polarity of charge applied to liquid crystal in (1) pair A of high frequency emphasized sub-frame pixels is set to a pair of [+] and [−], and also the polarity of charge applied to liquid crystal in (2) pair B of high frequency suppressed sub-frame pixels is set to a pair of [+] and [−]. That is, in each pixel of the liquid crystal panel 124, the AC drive controller 121 performs AC drive control of alternately switching the polarity between [+] and [−] in units of pairs of the same signal processing, each pair being two pixels on time series on which signal processing of the same category is performed in the video signal processor 101.

According to the above-described AC drive, when the pixel 351 is focused on, for example, a high frequency emphasized sub-frame pixel is displayed at times t1, t3, t5, t7, . . . . The polarity is alternately switched between [+] and [−] in frames corresponding to the respective times. Likewise, a high frequency suppressed sub-frame pixel is displayed at times t2, t4, t6, t8, . . . . The polarity is alternately switched between [+] and [−] in frames corresponding to the respective times.

As a result, alternate switching between [+] and [−] is performed during display of the high frequency emphasized sub-frame pixel. Accordingly, balance of [+] and [−] is maintained and accumulation of [+] or [−] voltage can be prevented. Also, alternate switching between [+] and [−] is performed during display of the high frequency suppressed sub-frame pixel. Accordingly, balance of [+] and [−] is maintained and accumulation of [+] or [−] voltage can be prevented. In this process example, AC drive is repeated in a pattern of [+][−][−][+] on a four-frame cycle.

PROCESS EXAMPLE 4

Hereinafter, control to display an image in which a high frequency suppressed sub-frame and a high-frequency emphasized sub-frame are alternately output and adjustment of output level of interpolation pixels is performed is described. In process example 3, a high frequency emphasized sub-frame and a high frequency suppressed sub-frame are alternately displayed in order to display a double speed frame image of 120 Hz. In this display method, as in the above-described process example 2, an image same as original content can be displayed by decreasing an output level of interpolation pixels. Hereinafter, AC drive of performing such a display process is described as process example 4.

Figure 9:
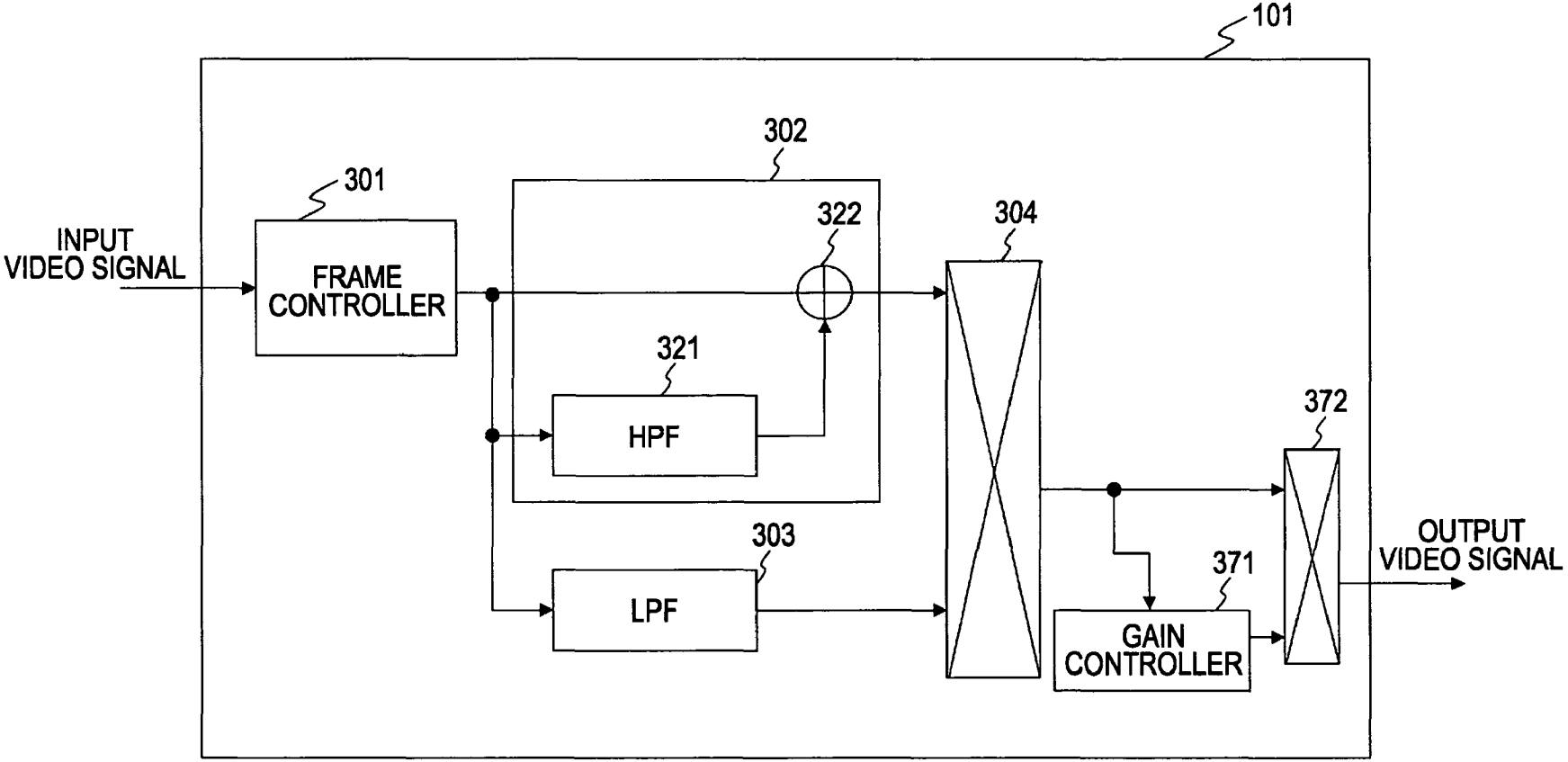
FIG. 9 shows another example of the configuration of the signal processing circuit of the video signal processor in the image display apparatus according to the embodiment of the present invention.

In this process example, the video signal processor 101 shown in FIG. 3 performs signal processing on the basis of an input video signal so as to generate high frequency emphasized and high frequency suppressed sub-frames, and also controls the level of interpolation pixels. Hereinafter, an example of video signal processing performed in the video signal processor 101 corresponding to this process example is described with reference to FIG. 9. As shown in FIG. 9, the video signal processor 101 includes the frame controller 301, the high frequency emphasized sub-frame generator 302, the LPF 303 serving as a high frequency suppressed sub-frame generator, the selector 304, a gain controller 371, and a selector 372. The high frequency emphasized sub-frame generator 302 includes the HPF 321 and the adder 322.

This configuration is equivalent to the configuration shown in FIG. 7 added with the gain controller 371 and the selector 372. From start to output of the selector 304, the process performed here is the same as that described above with reference to FIG. 7. That is, a high frequency emphasized sub-frame and a high frequency suppressed sub-frame are alternately output from the selector 304.

The high frequency emphasized sub-frame and the high frequency suppressed sub-frame are input to the gain controller 371 and the selector 372. The gain controller 371 controls the gain of each input frame. During control of the gain, an output level of an input pixel value signal is adjusted and the output level is decreased to 1× or less. That is, gain control of decreasing the luminance level of an output signal is performed. The purpose of decreasing the gain is to decrease the output level of interpolation pixels generated by interpolation in IP conversion.

The selector 372 receives the high frequency emphasized sub-frame and high frequency suppressed sub-frame output from the selector 304 in the previous stage, also receives the high frequency emphasized sub-frame and high frequency suppressed sub-frame of which level is decreased in the gain controller 371, and selects and outputs those frames in units of lines on the basis of a control signal. That is, data whose level is decreased in the gain controller 371 is output for a pixel line generated by interpolation in IP conversion, whereas data directly input from the selector 304 and on which gain control is not performed is output for an original pixel line other than the interpolation pixel line.

Figure 10:
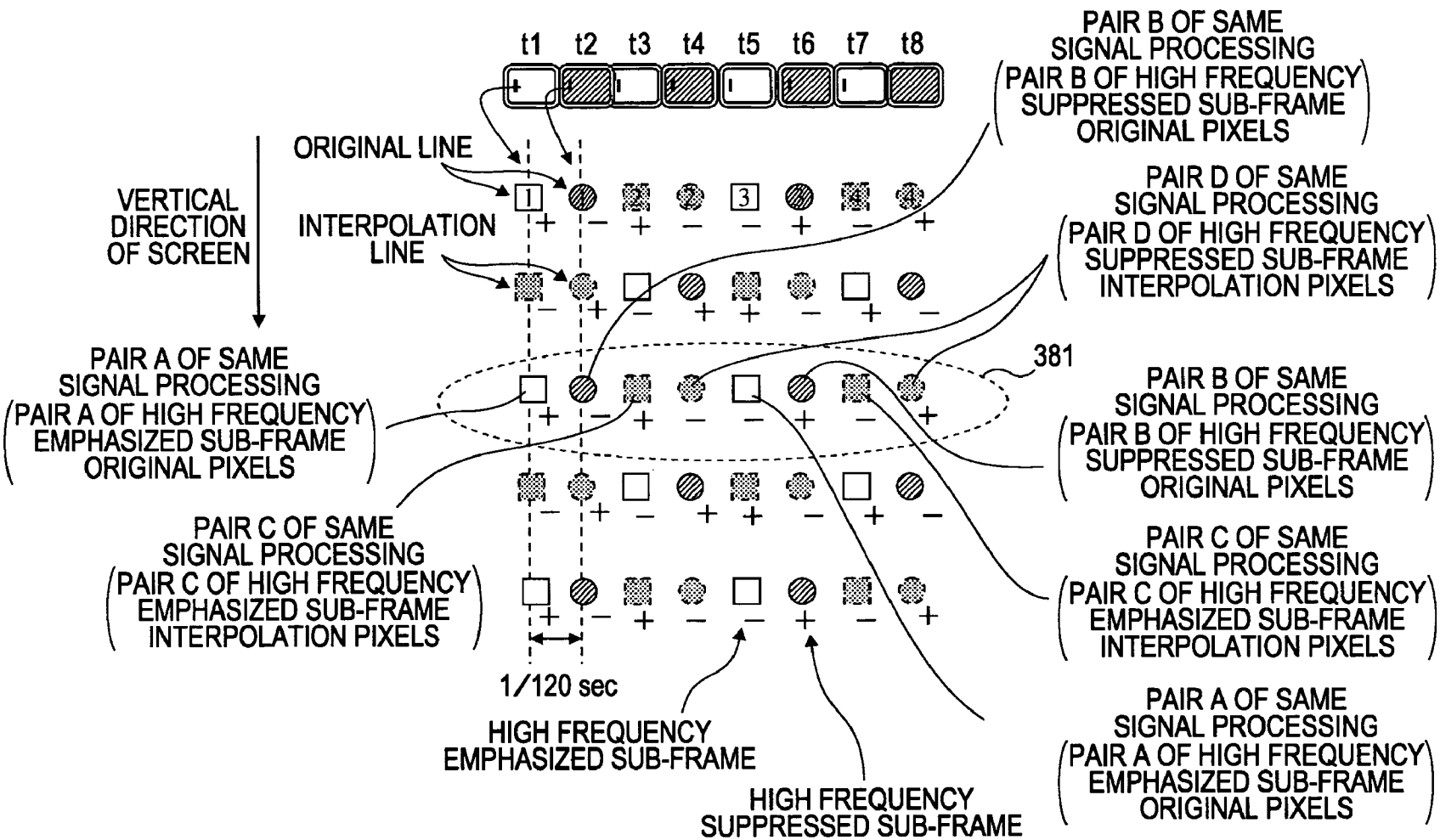
FIG. 10 illustrates another example of the AC drive process (process example 4) performed in the image display apparatus according to the embodiment of the present invention.

AC drive of alternately displaying the above-described high frequency emphasized sub-frame and high frequency suppressed sub-frame is described with reference to FIG. 10. FIG. 10 shows, in time series, pixels in the vertical direction of a frame image displayed in the display unit. For example, the image is a 120 Hz image generated by doubling a 60 Hz image. The interframe spacing between respective times t1, t2, t3, t4, . . . is 1/120 sec. In this process example, a high frequency emphasized sub-frame and a high frequency suppressed sub-frame are alternately displayed at intervals of 1/120 sec. Additionally, the output level of an original pixel line included in the high frequency emphasized sub-frame and high frequency suppressed sub-frame is set to high, but the output level of an interpolation pixel line is set to low.

In the image display apparatus according to the embodiment of the present invention, as described above in process example 1, a pair of pixels on which the same signal processing is performed in the time direction in a target pixel (or a target pixel line) is set, and AC drive of alternately switching between [+] and [−] is performed in units of pairs of the same signal processing.

In the example of the process of displaying a 120 Hz image shown in FIG. 10, a target pixel 381 is focused on, for example. In this case, a pixel corresponding to a high frequency emphasized sub-frame is displayed at times t1, t3, t5, t7, . . . , whereas a pixel corresponding to a high frequency suppressed sub-frame is displayed at times t2, t4, t6, t8, . . . . Furthermore, among times t1, t3, t5, t7, . . . , when a pixel corresponding to a high frequency emphasized sub-frame is displayed, times t1 and t5 correspond to the frames where an original pixel line of a high output level is displayed, and times t3 and t7 correspond to the frames where an interpolation pixel line of a low output level is displayed. Among times t2, t4, t6, t8, . . . , when a pixel corresponding to a high frequency suppressed sub-frame is displayed, times t2 and t6 correspond to the frames where an original pixel line of a high output level is displayed, and times t4 and t8 correspond to the frames where an interpolation pixel line of a low output level is displayed.

In this process of displaying pixels, pairs on which the same signal processing is performed are defined as follows, as shown in FIG. 10:

(1) pair A of high frequency emphasized sub-frame original pixels;

(2) pair B of high frequency suppressed sub-frame original pixels;

(3) pair C of high frequency emphasized sub-frame interpolation pixels; and (4) pair D of high frequency suppressed sub-frame interpolation pixels.

In this process example, AC drive of alternately switching between [+] and [−] is performed in units of pairs of the same signal processing. More specifically, the polarity of charge applied to liquid crystal in (1) pair A of high frequency emphasized sub-frame original pixels is set to a pair of [+] and [−], and the polarity of charge applied to liquid crystal in (2) pair B of high frequency suppressed sub-frame original pixels is set to a pair of [+] and [−]. Also, the polarity of charge applied to liquid crystal in (3) pair C of high frequency emphasized sub-frame interpolation pixels is set to a pair of [+] and [−], and the polarity of charge applied to liquid crystal in (4) pair D of high frequency suppressed sub-frame interpolation pixels is set to a pair of [+] and [−]. In this way, in each pixel of the liquid crystal panel 124, the AC drive controller 121 performs AC drive control of alternately switching the polarity between [+] and [−] in units of pairs of the same signal processing, each pair being two pixels on time series on which signal processing of the same category is performed in the video signal processor 101.

According to the above-described AC drive, when the target pixel 381 is focused on, for example, (1) a high frequency emphasized sub-frame original pixel is displayed at times t1, t5, . . . . The polarity is alternately switched between [+] and [−] in frames corresponding to the respective times. Likewise, (2) a high frequency suppressed sub-frame original pixel is displayed at times t2, t6, . . . . The polarity is alternately switched between [+] and [−] in frames corresponding to the respective times. Also, (3) a high frequency emphasized sub-frame interpolation pixel is displayed at times t3, t7, . . . . The polarity is alternately switched between [+] and [−] in frames corresponding to the respective times. Likewise, (4) a high frequency suppressed sub-frame interpolation pixel is displayed at times t4, t8, . . . . The polarity is alternately switched between [+] and [−] in frames corresponding to the respective times.

As a result, alternate switching between [+] and [−] is performed during display of respective pairs of the same signal processing. Accordingly, balance of [+] and [−] is maintained and accumulation of [+] or [−] voltage can be prevented. In this process example, AC drive is repeated in a pattern of [+][−][+][−][−][+][−][+] on an eight-frame cycle.

Figure 11:
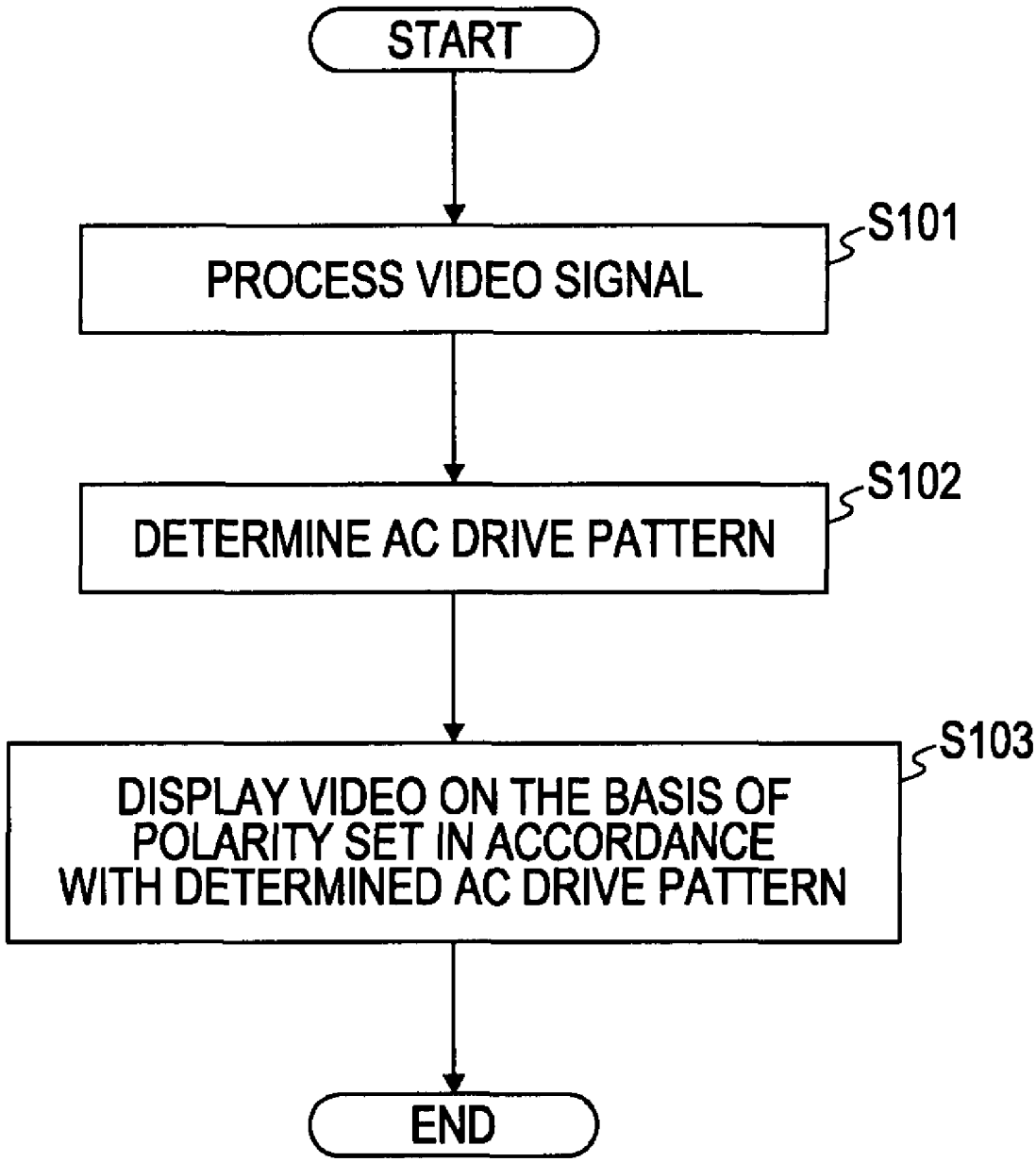
FIG. 11 is a flowchart illustrating a process sequence performed in the image display apparatus according to the embodiment of the present invention.

Now, a process sequence performed in the image display apparatus according to the embodiment of the present invention is described with reference to the flowchart shown in FIG. 11. The process according to the flowchart shown in FIG. 11 is performed in the image display apparatus shown in FIG. 3. The entire process is controlled by the controller 103 shown in FIG. 3. For example, the controller 103 includes a CPU (central processing unit) and controls the process in accordance with a computer program recorded in a memory.

Hereinafter, the respective steps in the process shown in the flowchart in FIG. 11 are described. First, in step S101, a video signal is processed. This step is performed in the video signal processor 101 shown in FIG. 3, and includes IP conversion, n×process, and level control. That is, a process is performed in accordance with each display form.

Then, in step S102, an AC drive pattern is determined. This step is performed in the AC drive pattern determining unit 122 shown in FIG. 3. The AC drive pattern determining unit 122 determines an AC drive pattern in accordance with the form of an image to be displayed on the liquid crystal panel 124. The form of an image to be displayed on the liquid crystal panel 124 can be set by a user through the user input unit 104. Information input through the user input unit 104 is input to the controller 103 and is supplied from the controller 103 to the AC drive pattern determining unit 122 of the liquid crystal module 120. The AC drive pattern determining unit 122 determines an AC drive pattern adaptable to the display form on the basis of the input information. For example, an AC drive pattern of [+][+][−][−] on a four-frame cycle is determined.

Then, in step S103, setting of polarity is changed in accordance with the determined AC drive pattern and AC drive is performed, so that an image is output. This step is performed in the AC drive controller 121 in the liquid crystal module 120 shown in FIG. 3. The AC drive controller 121 receives a video signal, a horizontal synchronizing signal (H_Sync), and a vertical synchronizing signal (V_Sync) from the video signal processor 101, drives the data drivers 123*a* and 123*b* while changing the setting of polarity on the basis of the AC drive pattern information received from the AC drive pattern determining unit 122, and displays image data on the liquid crystal panel 124.

In the image display apparatus according to the embodiment of the present invention, a pair of pixels on which the same signal processing is performed in the time direction in a target pixel (or a target pixel line) is set, and AC drive of alternately switching between [+] and [−] is performed in units of pairs of the same signal processing. With this process, switching between [+] and [−] is performed during display of respective pairs of the same signal processing. Accordingly, balance of [+] and [−] is maintained, accumulation of [+] or [−] voltage can be prevented, and the possibility of occurrence of burn-in can be decreased.

In the above-described embodiment, the AC drive pattern determining unit 122 serves as an independent element in the liquid crystal module 120 in the configuration shown in FIG. 3. Alternatively, the process of determining an AC drive pattern may be performed in the video signal processor 101. This process configuration is described below with reference to FIG. 12.

Figure 12:
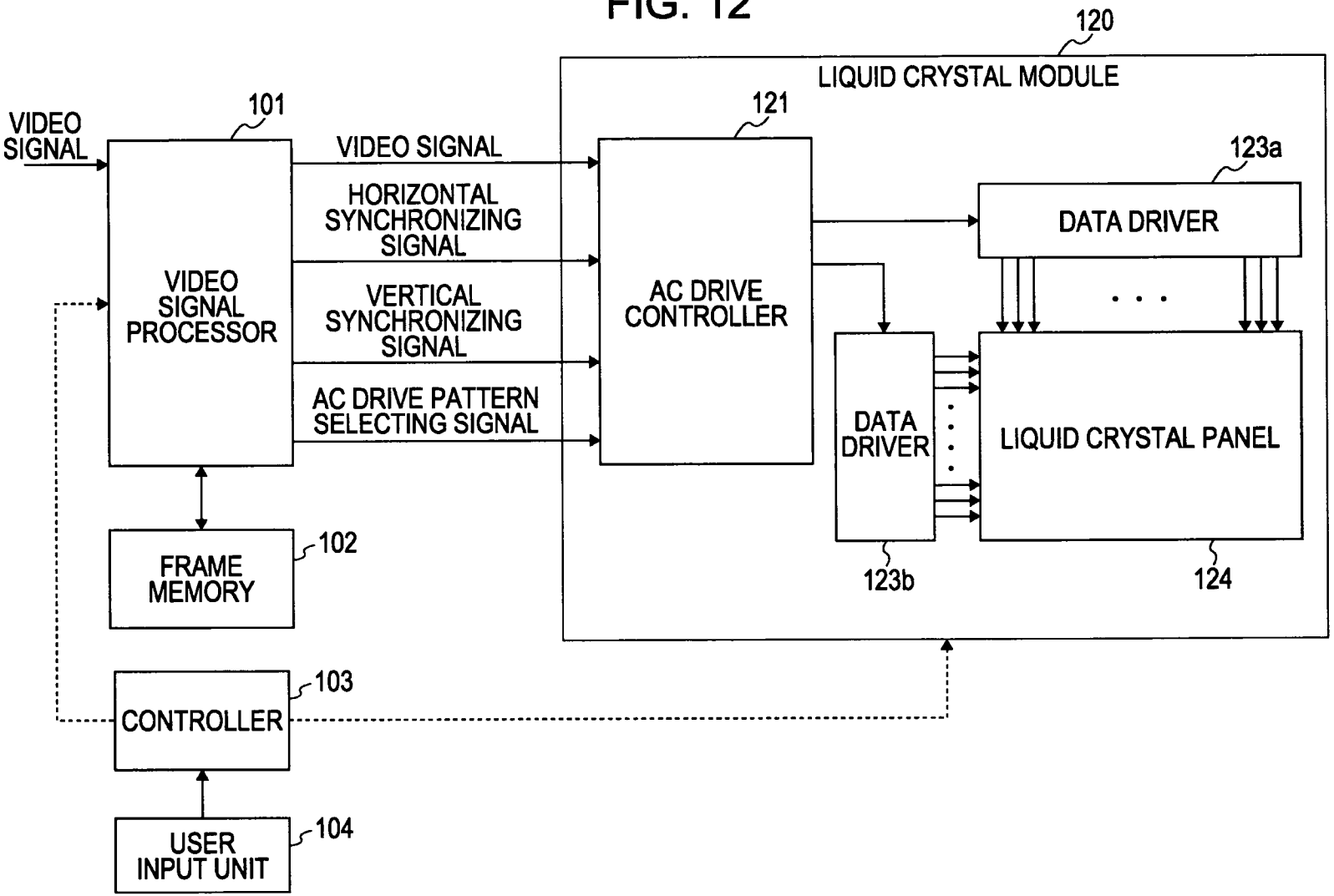
FIG. 12 is a block diagram showing another example of the configuration of the signal processing circuit in the image display apparatus according to the embodiment of the present invention.

In the configuration shown in FIG. 12, unlike in the configuration shown in FIG. 3, the AC drive pattern determining unit 122 is not an independent element in the liquid crystal module 120, but the process of determining an AC drive pattern is performed in the video signal processor 101. For example, information about a display form of an image set by a user in the user input unit 104 is input to the video signal processor 101 via the controller 103, and an AC drive pattern according to the display form is determined in the video signal processor 101. The video signal processor 101 inputs an AC drive pattern selecting signal to the AC drive controller 121 on the basis of the determined pattern. The AC drive controller 121 selects one of a plurality of prepared AC drive patterns on the basis of the AC drive pattern selecting signal received from the video signal processor 101 and performs AC drive.

Figure 13:
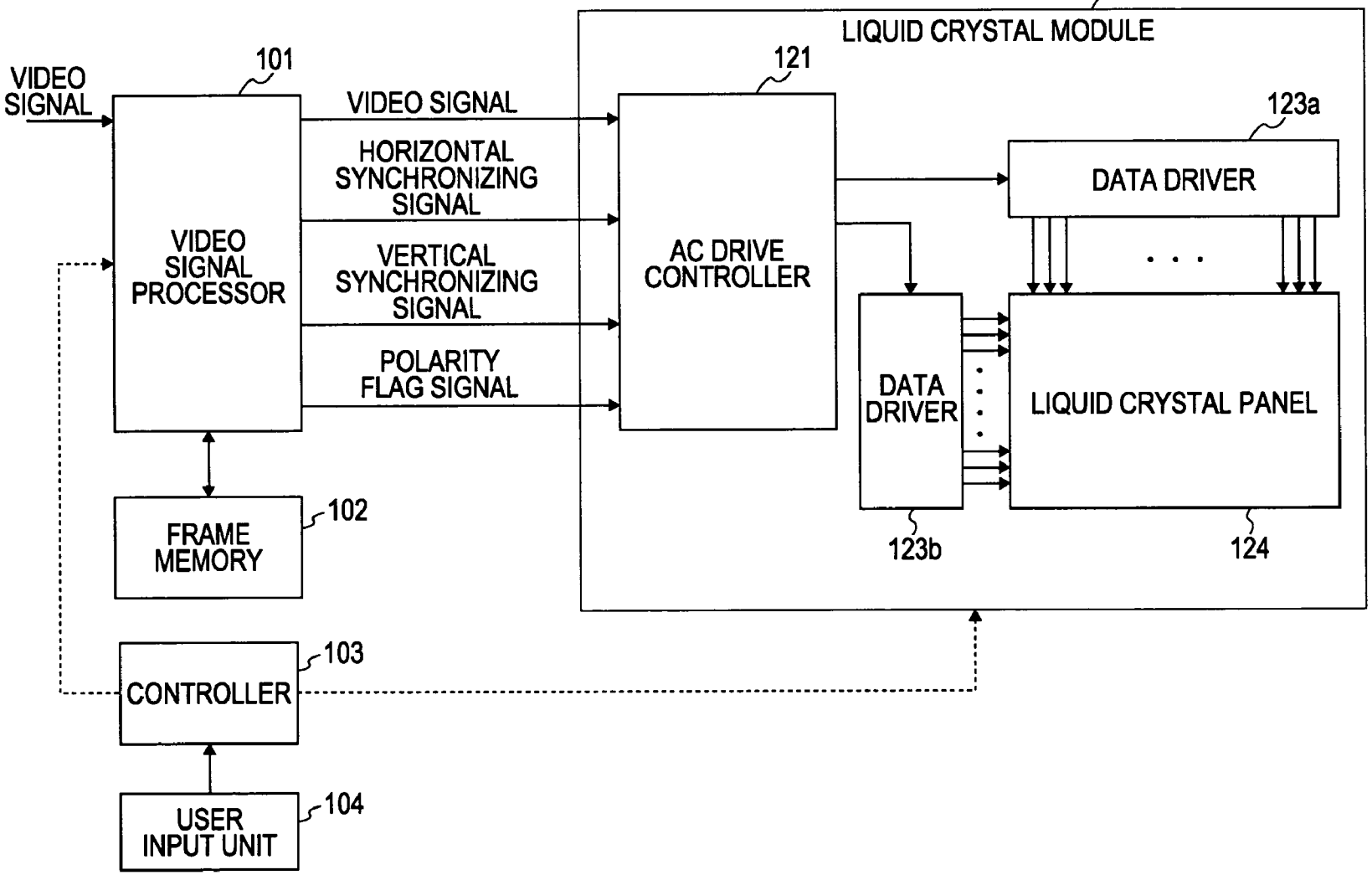
FIG. 13 is a block diagram showing another example of the configuration of the signal processing circuit in the image display apparatus according to the embodiment of the present invention.

The AC drive patterns may not be prepared in advance. For example, polarity setting information may be sequentially input from the video signal processor 101 to the AC drive controller 121 so that polarities are sequentially set, and AC drive may be performed accordingly. This process configuration is described below with reference to FIG. 13.

For example, information about a display form of an image set by a user in the user input unit 104 is input to the video signal processor 101 via the controller 103. An AC drive pattern according to the display form is determined in the video signal processor 101, polarities according to the determined pattern are sequentially determined, and a flag indicating the determined polarities is input from the video signal processor 101 to the AC drive controller 121. The AC drive controller 121 sequentially sets the polarities in accordance with the input flag so as to perform AC drive.

Figure 14:
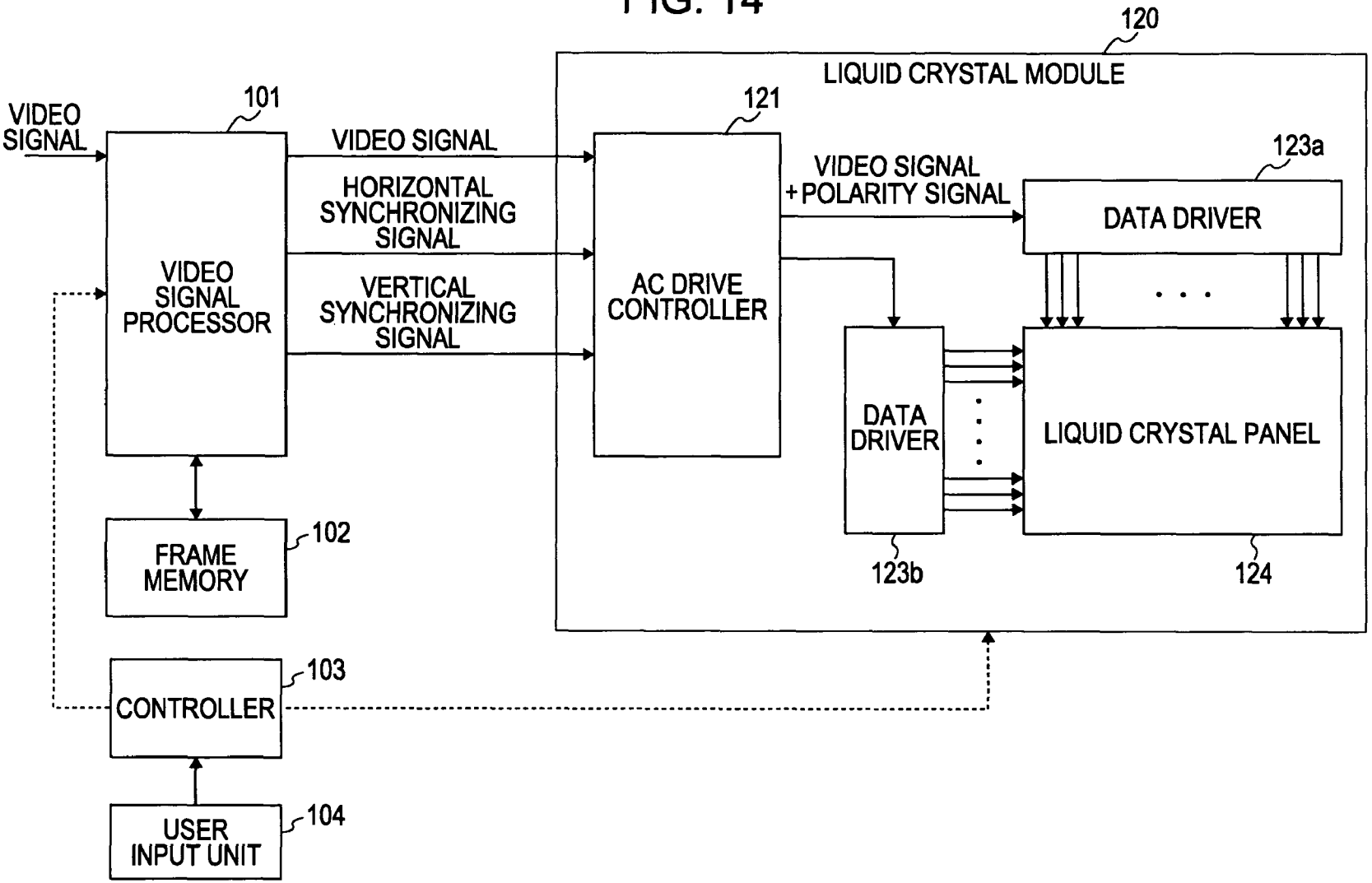
FIG. 14 is a block diagram showing another example of the configuration of the signal processing circuit in the image display apparatus according to the embodiment of the present invention.

The setting of polarities according to the AC drive pattern determined in accordance with the display form may be performed in the AC drive controller 121. For example, referring to FIG. 14, information about a display form of an image set by a user in the user input unit 104 is input to the AC drive controller 121 of the liquid crystal module 120 via the controller 103. An AC drive pattern according to the display form is determined in the AC drive controller 121, polarities are sequentially determined in accordance with the determined pattern, a signal of the determined polarities is output to the data drivers 123*a* and 123*b* together with a video signal, and the polarities are sequentially set for performing AC drive.

As described above, various configurations can be adopted. In any of the configurations, a pair of pixels on which the same signal processing is performed in the time direction in a target pixel (or a target pixel line) is set, and AC drive of alternately switching between [+] and [−] is performed in units of pairs of the same signal processing. With this process, switching between [+] and [−] is performed during display of respective pairs of the same signal processing. Accordingly, balance of [+] and [−] is maintained, accumulation of [+] or [−] voltage can be prevented, and the possibility of occurrence of burn-in can be decreased.

The present invention has been described above with reference to specific embodiments. It should be understood by those skilled in the art that various modifications, combinations, sub-combinations and alterations may occur depending on design requirements and other factors insofar as they are within the scope of the appended claims or the equivalents thereof.

The series of processes described in this specification can be performed by hardware, software, or a mixed configuration of hardware and software. When the processes are performed by software, a program recording a processing sequence can be installed in a memory of a computer incorporated in a dedicated hardware or can be installed in a multi-purpose computer capable of performing various processes, so that the program can be performed.

For example, the program can be recorded in advance in a hard disk or a ROM (read only memory) serving as a recording medium. Alternatively, the program can be temporarily or permanently stored (recorded) in a removable recording medium, such as a flexible disk, a CD-ROM (compact disc read only memory), an MO (magneto optical) disc, a DVD (digital versatile disc), a magnetic disk, or a semiconductor memory. The removable recording medium can be provided as so-called package software.

The program can be installed from the above-described removable recording medium to a computer. Alternatively, the program can be wirelessly transferred from a download site to the computer or can be transferred to the computer via a wired network, such as a LAN (local area network) or the Internet. The computer can receive the transferred program and install it in a recording medium, such as a built-in hard disk.

The various processes described in the specification may be performed in time series according to the described order. Alternatively, the processes may be performed in parallel or individually in accordance with the processing ability of an apparatus performing the processes or as necessary. In this specification, a system is a logical set of a plurality of devices, and the respective devices are not always in the same cabinet.

What is claimed is:

1. An image display apparatus comprising:

a display unit including a liquid crystal panel;

a video signal processor configured to perform signal processing on the basis of an image display form in the display unit; and an AC drive controller configured to control video display by receiving a result of the signal processing performed in the video signal processor and controlling a voltage applied to the liquid crystal panel included in the display unit, wherein the AC drive controller performs, for each pixel of the liquid crystal panel, AC drive control of alternately switching a polarity between + and − in units of pairs of the same signal processing, each pair being two pixels on time series on which signal processing of the same category is performed in the video signal processor.

2. The image display apparatus according to claim 1, further comprising:

an AC drive pattern determining unit configured to determine an AC drive pattern on the basis of the image display form in the display unit, wherein the AC drive controller performs AC drive control of alternately switching a polarity between + and − in units of pairs of the same signal processing in accordance with the AC drive pattern determined in the AC drive pattern determining unit.

3. The image display apparatus according to claim 1, wherein the AC drive controller receives an instruction signal from the video signal processor and performs AC drive control of alternately switching a polarity between + and − in units of pairs of the same signal processing on the basis of the instruction signal.

4. The image display apparatus according to claim 1, wherein the AC drive controller extracts the pairs of the same signal processing, the pairs including a pair of interpolation pixels which are interpolation line pixels generated in IP conversion, an output level of the interpolation pixels being decreased; and a pair of original pixels other than the interpolation pixels, and wherein the AC drive controller switches the polarity for each of the interpolation pixels constituting the pair of interpolation pixels and switches the polarity for each of the original pixels constituting the pair of original pixels.

5. The image display apparatus according to claim 4, wherein the AC drive controller extracts the pair of interpolation pixels and the pair of original pixels from image data on which n×process is performed, n being an integer of 2 or more, and switches the polarity for each of the interpolation pixels and each of the original pixels.

6. The image display apparatus according to claim 1, wherein the video signal processor includes:

a frame controller configured to generate a plurality of sub-frames by performing time division on an input image frame;

a high frequency emphasized sub-frame generator configured to generate high frequency emphasized sub-frames by filtering the sub-frames generated by the frame controller;

a high frequency suppressed sub-frame generator configured to generate high frequency suppressed sub-frames by filtering the sub-frames generated by the frame controller; and an output controller configured to alternately output the high frequency emphasized sub-frames generated by the high frequency emphasized sub-frame generator and the high frequency suppressed sub-frames generated by the high frequency suppressed sub-frame generator to the AC drive controller, wherein the AC drive controller extracts the pairs of the same signal processing, the pairs including a pair of pixels corresponding to the high frequency emphasized sub-frames; and a pair of pixels corresponding to the high frequency suppressed sub-frames, and wherein the AC drive controller switches the polarity for each of the pixels constituting the pair of pixels corresponding to the high frequency emphasized sub-frames and switches the polarity for each of the pixels constituting the pair of pixels corresponding to the high frequency suppressed sub-frames.

7. The image display apparatus according to claim 1, wherein the video signal processor includes:

a frame controller configured to generate a plurality of sub-frames by performing time division on an input image frame;

a high frequency emphasized sub-frame generator configured to generate high frequency emphasized sub-frames by filtering the sub-frames generated by the frame controller;

a high frequency suppressed sub-frame generator configured to generate high frequency suppressed sub-frames by filtering the sub-frames generated by the frame controller;

a first output controller configured to alternately output the high frequency emphasized sub-frames generated by the high frequency emphasized sub-frame generator and the high frequency suppressed sub-frames generated by the high frequency suppressed sub-frame generator;

a gain controller configured to adjust an output level of the sub-frame images output from the first output controller; and a second output controller configured to receive output from the first output controller and output from the gain controller, and to output level-adjusted interpolation pixels and level-nonadjusted original pixels to the AC drive controller, the level-adjusted interpolation pixels being generated by adjusting interpolation pixels generated by IP conversion with an output level adjusting signal output from the gain controller, and the level-nonadjusted original pixels being level-nonadjusted original pixel signals other than the interpolation pixels output from the first output controller, wherein the AC drive controller extracts the pairs of the same signal processing, the pairs including (a) a pair of high frequency emphasized sub-frame original pixels including original pixels included in the high frequency emphasized sub-frames;

(b) a pair of high frequency emphasized sub-frame interpolation pixels including level-adjusted interpolation pixels included in the high frequency emphasized sub-frames;

(c) a pair of high frequency suppressed sub-frame original pixels including original pixels included in the high frequency suppressed sub-frames; and (d) a pair of high frequency suppressed sub-frame interpolation pixels including level-adjusted interpolation pixels included in the high frequency suppressed sub-frames, and wherein the AC drive controller switches the polarity for each of the pixels constituting the respective pixel pairs (a) to (d).

8. A control signal generating apparatus to generate a control signal for controlling a display unit including a liquid crystal panel, the control signal generating apparatus comprising:

an AC drive controller configured to control video display by receiving a result of signal processing performed in a video signal processor and controlling a voltage applied to the liquid crystal panel included in the display unit, wherein the AC drive controller performs, for each pixel of the liquid crystal panel, AC drive control of alternately switching a polarity between + and − in units of pairs of the same signal processing, each pair being two pixels on time series on which signal processing of the same category is performed in the video signal processor.

9. The control signal generating apparatus according to claim 8, further comprising:

an AC drive pattern determining unit configured to determine an AC drive pattern on the basis of an image display form in the display unit, wherein the AC drive controller performs AC drive control of alternately switching a polarity between + and − in units of pairs of the same signal processing in accordance with the AC drive pattern determined in the AC drive pattern determining unit.

10. The control signal generating apparatus according to claim 8, wherein the AC drive controller receives an instruction signal from the video signal processor and performs AC drive control of alternately switching a polarity between + and − in units of pairs of the same signal processing on the basis of the instruction signal.

11. An AC drive control apparatus to control video display by controlling a voltage applied to a liquid crystal panel included in a display unit, wherein, in each pixel of the liquid crystal panel, the AC drive control apparatus performs AC drive control of alternately switching a polarity between + and − in units of pairs of the same signal processing, each pair being two pixels on time series on which signal processing of the same category is performed.

12. An image display control method for performing image processing in an image display apparatus, the method comprising the steps of:

performing video signal processing on the basis of an image display form in a display unit including a liquid crystal panel, the step being performed in a video signal processor; and performing AC drive control to control video display by receiving a result of the signal processing performed in the video signal processor and controlling a voltage applied to the liquid crystal panel included in the display unit, the step being performed in an AC drive controller, wherein the AC drive control step performs, for each pixel of the liquid crystal panel, AC drive control of alternately switching a polarity between + and − in units of pairs of the same signal processing, each pair being two pixels on time series on which signal processing of the same category is performed in the video signal processor.

13. A computer program product allowing an image display apparatus to perform image processing, comprising the steps of:

performing video signal processing on the basis of an image display form in a display unit including a liquid crystal panel, the step being performed in a video signal processor; and performing AC drive control to control video display by receiving a result of the signal processing performed in the video signal processor and controlling a voltage applied to the liquid crystal panel included in the display unit, the step being performed in an AC drive controller, wherein the AC drive control step performs, for each pixel of the liquid crystal panel, AC drive control of alternately switching a polarity between + and − in units of pairs of the same signal processing, each pair being two pixels on time series on which signal processing of the same category is performed in the video signal processor.

* * * * *